US010861277B2

(12) United States Patent
Bauer et al.

(10) Patent No.: US 10,861,277 B2
(45) Date of Patent: Dec. 8, 2020

(54) PRODUCT DISPENSER WITH AN S-SHAPED DOWN CHUTE

(71) Applicants: Giraffx Design, LLC, Lake Worth, FL (US); RTC Industries, Inc., Rolling Meadows, IL (US)

(72) Inventors: Jamie Bauer, Greenacres, FL (US); Joel Barenbrugge, Naperville, IL (US)

(73) Assignees: RTC INDUSTRIES, INC., Rolling Meadows, IL (US); GiRAFFX DESIGN, LLC, Lake Worth, FL (US)

( * ) Notice: Subject to any disclaimer, the term of this patent is extended or adjusted under 35 U.S.C. 154(b) by 0 days.

(21) Appl. No.: 14/472,340

(22) Filed: Aug. 28, 2014

(65) Prior Publication Data

US 2015/0001243 A1 Jan. 1, 2015

Related U.S. Application Data

(60) Provisional application No. 61/871,705, filed on Aug. 29, 2013, provisional application No. 61/871,692,
(Continued)

(51) Int. Cl.
*G07F 11/28* (2006.01)
*A47F 1/08* (2006.01)
(Continued)

(52) U.S. Cl.
CPC ..... *G07F 11/28* (2013.01); *A47F 1/04* (2013.01); *A47F 1/087* (2013.01); *B65D 5/725* (2013.01);
(Continued)

(58) Field of Classification Search
CPC ..... G07F 11/28
See application file for complete search history.

(56) References Cited

U.S. PATENT DOCUMENTS 902,347 A 10/1908 Tillinghast
1,291,420 A 1/1919 Cough
(Continued)

FOREIGN PATENT DOCUMENTS

EP 1539607 B1 3/2009
JP 07124041 A 5/1995
(Continued)

OTHER PUBLICATIONS

International Search Report and Written Opinion for International Application No. PCT/US2014/027165, dated May 26, 2014.
(Continued)

*Primary Examiner* — Gene O Crawford
*Assistant Examiner* — Ayodeji T Ojofeitimi
(74) *Attorney, Agent, or Firm* — Shutts & Bowen LLP

(57) ABSTRACT

A serpentine product dispenser has a substantially "S"-shaped down chute between a cartridge containing rolling products, an exit port, and a lower feed channel leading to a product selection area. Jam-free feeding of cans from the cartridge is accomplished by forming the down chute in three arcuate sections. An upper arcuate section causes a first can falling through the exit port to impact a second can still in the dispenser, delaying motion of the second can, such that a third can follows the first can. A central arcuate section causes the first can to maintain rolling contact with a second can still in the cartridge, further facilitating the movement of the third can toward and into the down chute. A lower arcuate section directs cans toward the dispenser lower feed ramp and product selection area after they traverse the down chute upper and central arcuate sections.

15 Claims, 37 Drawing Sheets

Related U.S. Application Data filed on Aug. 29, 2013, provisional application No. 61/871,711, filed on Aug. 29, 2013.

(51) Int. Cl.
*A47F 1/04* (2006.01)
*B65D 71/36* (2006.01)
*B65D 5/72* (2006.01)

(52) U.S. Cl.
CPC ..... *B65D 71/36* (2013.01); *B65D 2571/0066* (2013.01); *B65D 2571/00141* (2013.01); *B65D 2571/00574* (2013.01); *B65D 2571/00728* (2013.01)

(56) References Cited

U.S. PATENT DOCUMENTS

| | | | |
|---|---|---|---|
| 1,898,056 | A | 2/1933 | Johnson |
| 2,382,191 | A | 8/1945 | Weichselbaum |
| 2,996,344 | A | 8/1961 | Garman |
| 3,055,293 | A | 9/1962 | Lariccia |
| 3,178,242 | A | 4/1965 | Ellis et al. |
| 3,203,554 | A | 8/1965 | Pendergrast, Jr. et al. |
| 3,300,115 | A | 1/1967 | Schauer |
| 3,784,022 | A | 1/1974 | Beesley, Jr. |
| 3,923,159 | A | 12/1975 | Taylor et al. |
| 4,228,903 | A | 10/1980 | Eckert |
| 4,435,026 | A | 3/1984 | Johnson |
| 4,598,828 | A | 7/1986 | Young et al. |
| 4,823,982 | A | 4/1989 | Aten et al. |
| 4,915,571 | A | 4/1990 | Toshihiko et al. |
| 5,289,943 | A | 3/1994 | Powell |
| 5,314,078 | A | 5/1994 | Morikiyo et al. |
| 5,328,258 | A | 7/1994 | Scalise |
| 5,390,821 | A | 2/1995 | Markel |
| D363,174 | S | 10/1995 | Fletcher |
| 5,462,198 | A | 10/1995 | Schwimmer |
| 5,540,315 | A | 7/1996 | Haiki et al. |
| 5,788,117 | A | 8/1998 | Zimmanck |
| 5,836,478 | A | 11/1998 | Weiss |
| 5,878,862 | A | 3/1999 | Dewsnap |
| 5,894,942 | A | 4/1999 | Miyashita et al. |
| 6,253,930 | B1 | 7/2001 | Freidus et al. |
| 6,991,116 | B2 | 1/2006 | Johnson et al. |
| 7,207,447 | B2 | 4/2007 | Medcalf et al. |
| 7,552,857 | B2 | 6/2009 | Harrelson |
| 7,717,321 | B2 | 5/2010 | Spivey, Sr. et al. |
| 7,918,365 | B2 * | 4/2011 | White ..... A47F 1/087 221/123 |
| 7,922,437 | B1 | 4/2011 | Loftin et al. |
| 7,992,747 | B2 | 8/2011 | Bauer |
| 8,047,400 | B1 | 11/2011 | Luberto et al. |
| 8,127,980 | B2 | 3/2012 | Spivey, Sr. et al. |
| 8,162,206 | B2 | 4/2012 | Harrelson |
| 8,302,809 | B1 | 11/2012 | Bogdziewicz, III et al. |
| 8,308,023 | B2 | 11/2012 | Gelardi et al. |
| 8,322,543 | B2 | 12/2012 | Gelardi et al. |
| 8,448,815 | B2 | 5/2013 | Sholl et al. |
| 8,550,261 | B2 | 10/2013 | Loftin et al. |
| 8,628,003 | B2 | 1/2014 | Thomas et al. |
| 8,668,114 | B2 | 3/2014 | Gerlardi et al. |
| 2004/0200789 | A1 | 10/2004 | Woodbury |
| 2005/0127015 | A1 | 6/2005 | Medcalf et al. |
| 2006/0091191 | A1 | 5/2006 | DeBusk |
| 2006/0180488 | A1 | 8/2006 | Spivey, Sr. et al. |
| 2007/0007221 | A1 | 1/2007 | Mann |
| 2009/0212066 | A1 | 8/2009 | Bauer |
| 2009/0308885 | A1 | 12/2009 | Sainato et al. |
| 2010/0096401 | A1 | 4/2010 | Sainato et al. |
| 2010/0072150 | A1 | 5/2010 | Takashima et al. |
| 2010/0187295 | A1 | 7/2010 | Spivey, Sr. et al. |
| 2010/0252619 | A1 | 10/2010 | Harrelson |
| 2011/0121010 | A1 | 5/2011 | Loftin et al. |
| 2011/0121011 | A1 | 5/2011 | Gelardi et al. |
| 2012/0018391 | A1 | 1/2012 | Gelardi et al. |
| 2012/0074160 | A1 | 3/2012 | Thomas et al. |
| 2012/0074164 | A1 | 3/2012 | Walling et al. |
| 2012/0097694 | A1 | 4/2012 | Gelardi |
| 2012/0104082 | A1 | 5/2012 | Spivey, Sr. et al. |
| 2012/0211510 | A1 | 8/2012 | Gelardi et al. |
| 2012/0211522 | A1 | 8/2012 | Gelardi et al. |
| 2012/0217213 | A1 | 8/2012 | Thomas |
| 2012/0217261 | A1 | 8/2012 | Bailey et al. |
| 2012/0223090 | A1 | 9/2012 | Thomas et al. |
| 2012/0228247 | A1 | 9/2012 | Loftin et al. |
| 2012/0279893 | A1 | 11/2012 | Gerlardi et al. |
| 2012/0285976 | A1 | 11/2012 | Bogdziewicz, III et al. |
| 2012/0285977 | A1 | 11/2012 | Bates et al. |
| 2012/0318817 | A1 | 12/2012 | Zacherle et al. |
| 2012/0325839 | A1 | 12/2012 | Bates et al. |
| 2013/0020341 | A1 | 1/2013 | Bogdziewicz, III et al. |
| 2013/0062360 | A1 | 3/2013 | Bogdziewicz, III et al. |
| 2013/0062361 | A1 | 3/2013 | Loflin et al. |
| 2013/0105509 | A1 | 5/2013 | Gelardi et al. |
| 2013/0134119 | A1 | 5/2013 | Loftin et al. |
| 2013/0134177 | A1 | 5/2013 | Loftin |
| 2013/0221017 | A1 | 8/2013 | Zacherle et al. |
| 2013/0221020 | A1 | 8/2013 | Zacherle et al. |
| 2013/0233813 | A1 | 9/2013 | Zacherle et al. |
| 2013/0248468 | A1 | 9/2013 | Burton et al. |
| 2013/0270203 | A1 | 10/2013 | Burton et al. |
| 2013/0277321 | A1 | 10/2013 | Zacherle |
| 2013/0277385 | A1 | 10/2013 | Zacherle |
| 2014/0001200 | A1 | 1/2014 | Bates et al. |
| 2014/0054310 | A1 | 2/2014 | Loftin et al. |
| 2014/0061217 | A1 * | 3/2014 | Fortuna ..... A47F 1/087 221/1 |
| 2014/0076922 | A1 | 3/2014 | Binshtok et al. |
| 2014/0102942 | A1 | 4/2014 | Thomas et al. |
| 2014/0103056 | A1 | 4/2014 | Thomas et al. |

FOREIGN PATENT DOCUMENTS

| | | | |
|---|---|---|---|
| JP | 11346880 | A | 12/1999 |
| JP | 2008080058 | A | 4/2008 |
| JP | 2013537443 | A | 10/2013 |
| JP | 2013540663 | A | 11/2013 |
| WO | 2011063117 | A1 | 5/2011 |
| WO | 2012012201 | A1 | 1/2012 |
| WO | 2012012677 | A1 | 1/2012 |
| WO | 2012040053 | A1 | 3/2012 |
| WO | 2012082233 | A1 | 6/2012 |
| WO | 2012115727 | A1 | 8/2012 |
| WO | 2012115728 | A1 | 8/2012 |
| WO | 2012118776 | A1 | 9/2012 |
| WO | 2013036439 | A1 | 3/2013 |
| WO | 2013036443 | A1 | 3/2013 |
| WO | 2013078113 | A2 | 5/2013 |
| WO | 2013081810 | A1 | 6/2013 |
| WO | 2013081814 | A1 | 6/2013 |
| WO | 2013126215 | A1 | 8/2013 |
| WO | 2013126218 | A1 | 8/2013 |
| WO | 2013158434 | A1 | 10/2013 |
| WO | 2013162942 | A1 | 10/2013 |
| WO | 2013163014 | A1 | 10/2013 |

OTHER PUBLICATIONS

International Search Report and Written Opinion for International Application No. PCT/US2014/053372, dated Dec. 12, 2014.
International Search Report and Written Opinion for International Application No. PCT/US2014/053417, dated Nov. 21, 2014.
International Search Report and Written Opinion for International Application No. PCT/US2014/053432, dated Nov. 14, 2014.

* cited by examiner

PRODUCT DISPENSER WITH AN S-SHAPED DOWN CHUTE

REFERENCE TO RELATED APPLICATIONS

This application claims one or more inventions which were disclosed in Provisional Application No. 61/871,705, filed Aug. 29, 2013, entitled "Product Dispenser With An S-Shaped Down Chute"; Provisional Application No. 61/871,692, filed Aug. 29, 2013, entitled "Dispenser For Rolling Product And Dispenser Cartridges"; and, Provisional Application No. 61/871,711, filed Aug. 29, 2013, entitled "Dispenser With Wedge For Rolling Products". The benefit under 35 USC § 119(e) of the United States provisional applications is hereby claimed, and the aforementioned applications are hereby incorporated herein by reference.

BACKGROUND OF THE INVENTION

Field of the Invention

The invention pertains to the field of product dispensers. More particularly, the invention pertains to a serpentine product dispensing unit that is filled from a bulk rolling product cartridge, container, or hopper.

Description of Related Art

A dispenser with a cartridge containing multiple rolling product packages, Bauer (U.S. Pat. No. 7,992,747 for example), accommodates a variety of different bulk packed product shipping cartons [henceforth referred to as "cartridge(s)"] with a variety of can counts or arrangements packed therein. As shown in prior art FIGS. 1 and 2, it is often desirable to stack cans two or more wide in the cartridge 10 in its shipping orientation (with the cans vertical therein), or two or more rows high in the "at use" position (when the cartridge 10 is inside the dispenser 20 as shown in prior art FIGS. 4-18).

This configuration is most commonly known from cartridges 10 for canned soda and other carbonated beverages; however almost any product packed in cans, bottles, or other configuration capable of rolling can be so packaged. This is also true for stacks of nested cans, as shown in prior art FIG. 3, where each nested stack functions as if it was a single can. One skilled in the art of dispensers 20 and bulk shipping cartridges 10 will therefore appreciate that the operation of dispensers 20 and cartridges 10 described herein applies equally to rows of single cans, stacks of nested cans, and any packaging configuration that is capable of rolling. Similarly, one skilled in the art will appreciate that dispensers 20 that have hoppers for cans that are manually filled rather than utilizing a pre-fill cartridge 10 function similarly, as the hopper substantially orients cans in the same way a pre-filled cartridge 10 does when the cartridge 10 is inserted into a dispenser. Such bulk shipping cartridges 10 and associated dispensers 20 are more flexible for retailers or brand marketers and assist with the efficient management of supply chains and sales.

When a pre-filled cartridge 10 is inserted into the cartridge holding area 24 (FIG. 4) of completely empty matching dispenser 20, such as shown in FIGS. 4-11, the cartridge 10 loads and products feed through the dispenser and are generally dispensed to shoppers according to design expectations. Prior art FIG. 4 shows a cartridge 10 being loaded into a prior art dispenser 20 cartridge holding area 24 after an opening has been made in the bottom of the rear end of the cartridge 10 to allow cans to exit the cartridge 10 and enter the dispenser 20 through an exit port 45.

The sequence of events after loading is shown in prior art FIGS. 5-11 in detail. Starting with prior art FIG. 5, the first four cans 1, 2, 3, 4, (henceforth, "can" or "cans" includes, but is not limited to, a conventional metal can or cans, a stack of nested cans, stacks of nested cans, and any other packaging form that is capable of rolling), that exit the cartridge 10 during feeding are critical to the proper operation of the cartridge 10 and dispenser 20 system. It has been found that, after these first four cans 1, 2, 3, 4, exit the cartridge 10 the balance of cans in the cartridge 10 have sufficient room to move inside the cartridge 10 so that no jamming occurs thereafter. The exiting of these first four cans 1, 2, 3, 4 no matter the size or weight of the cans, therefore determines the efficient and reliable feeding of all the cans from the cartridge 10 into and through the dispenser 20 to a product selection location 25 where they can be selected by the consumer.

Referring again to prior art FIG. 5, immediately after the cartridge 10 is loaded into the dispenser 20, can 1 is free to exit the cartridge 10, drop vertically downward through the exit port 34, roll along the down chute 30, and then roll along the lower feed ramp 40 to the product selection area 25. Similarly, as shown in prior art FIG. 6, can 2 is generally free to also follow can 1, falling vertically downward from the cartridge 10, through the exit port 45, into the dispenser 20, and roll to the product selection area 25.

However, experience has shown that successful feeding of cans 3, 4 is largely due to the impacts and vibrations caused by the first cans 1, 2 transiting the dispenser. Impacts and vibrations dislodge products lodged in the cartridge 10 or stuck in between the dispenser down chute 30 and loading ramp 35, as illustrated in prior art FIGS. 7, 8, and 10 for example. Thus, reliable dispenser feeding is more a matter of chance rather than a result of a truly functional dispenser 20/cartridge 10/can 1, 2, 3, 4 interaction. As shown in prior art FIGS. 7 and 8, after cans 1 and 2 exit the cartridge 10, cans 3 and 4 may be positioned such that they cause a feed jam. While the impact of cans 1 and 2 with the down chute 30 (prior art FIG. 7), or the product selection area 25 (prior art FIG. 8) may cause sufficient vibration in the dispenser 20 to dislodge the feed jam, this is by no means guaranteed and is not always the case. However, assuming such impacts do occur and free can 4 (prior art FIG. 9), it is then free to roll along the down chute 30 to the product selection area 25, and can 3 follows suit (prior art FIG. 10), followed by the rest of the cans in the cartridge 10 until the dispenser 20 is full of product (prior art FIG. 11).

Referring now to prior art FIGS. 12-18, while restocking the dispenser 20 by inserting a new cartridge 10 full of cans into the cartridge holding area 24 when the lower feed ramp 40 is not empty, there is insufficient can 1, 2, 3, 4 movement to cause such impacts and vibrations. The sequence of events in this circumstance is similar to the events illustrated in prior art FIGS. 5-8, that occur when filling an empty dispenser 20.

Prior art FIG. 12 shows a full cartridge 10 being inserted into the cartridge holding area 24 of a dispenser 20 that remains partially filled with previously loaded cans. Immediately after inserting the cartridge 10 (prior art FIG. 13), can 1 is free to move through the exit port 45, and roll along the down chute 30, but only until it contacts the rearmost previously loaded can in the lower channel. As shown in prior art FIG. 14, can 2 drops immediately down behind can 1, and can 4 is biased to roll over can 3. This restocking situation thus shortens the distance cans 1 and 2 move in the dispenser, which significantly reduces the previously described impacts and vibrations. As shown in prior art FIG.

15, when a can is removed from the product selection area 25, can 1 and can 2 move along the down chute 30, with can 4 biased to follow by rolling over the top of can 3. At this point, shown in prior art FIGS. 15-16, can 3 and can 4 are in a position that may potentially result in a jam. While the cans remaining in the dispenser 20 lower feed ramp 40 may still be selected, the jam (prior art FIG. 17) prevents product movement from the cartridge 10 through the exit port 45.

As a result of this sequence of events, products tend to jam either inside the cartridge 10 prior to exiting the exit port 45, as shown in prior art FIG. 12-17, or within the down chute 30 of the dispenser (prior art FIG. 18), depending on the various relationships between the exit port 45 size, the can diameter, the down chute 30 configuration, and other factors. Such jams are unacceptable because dispensing cans to shoppers becomes unreliable and increases, rather than decreases, the manual labor and time needed to maintain the system, as presently occurs with similar prior art dispensers in stores.

SUMMARY OF THE INVENTION

A serpentine product dispenser is constructed to create a cartridge holding area into which a cartridge holding multiple rows of cans is inserted to load the dispenser. An exit port below the cartridge holding area at the back of the dispenser allows cans to move from the cartridge into the dispenser. A loading ramp at the bottom of the cartridge holding area is oriented at an angle of approximately seven degrees or less, sloping from the dispenser front to the exit port, and biases cans in the cartridge to roll toward the back of the dispenser and into the exit port. A substantially "S"-shaped down chute formed from three arcuate sections is located below the exit port and directs cans through the exit port in a controlled fashion to a lower feed ramp and a product selection area where the cans may be selected by a consumer. Jam-free feeding of cans from the cartridge through the exit port down chute is accomplished by forming the down chute in three arcuate sections. An upper arcuate section causes a first can moving through the exit port to maintain contact with a second can still in the cartridge, delaying the motion of the second can, such that a third can moves into a space previously occupied by the first can. A central arcuate section causes the first can to maintain rolling contact with a second can in the cartridge, further facilitating the movement of a third can into a position previously occupied by the first can as the first can continues to move into the dispenser. A lower arcuate section directs the first can toward the dispenser lower feed ramp and product selection area after it has traversed the down chute upper and central arcuate sections.

DETAILED DESCRIPTION OF THE INVENTION

Figure 5:
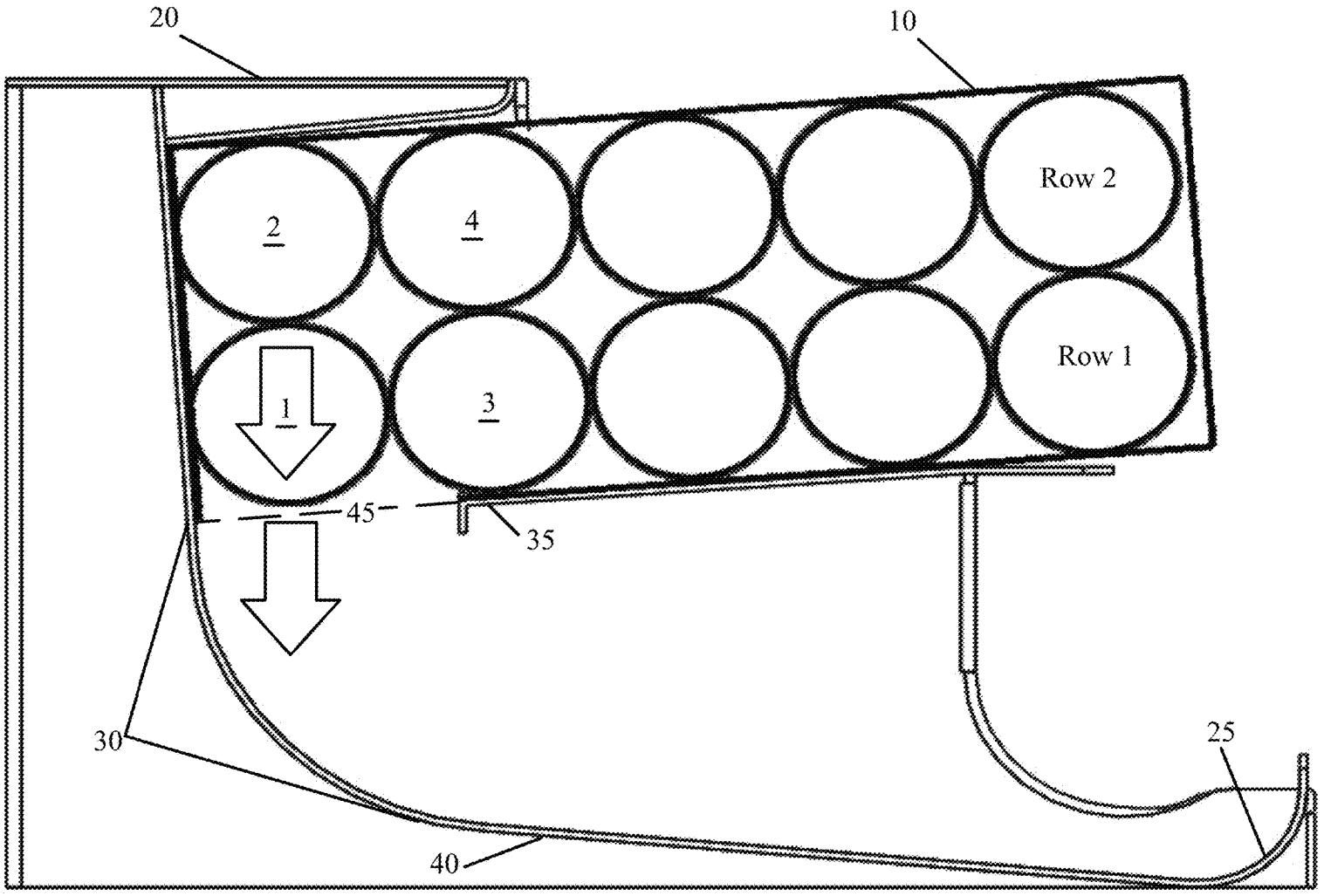
FIG. 5 PRIOR ART
FIG. 5 shows a side view of a prior art double row product cartridge in a prior art dispenser with a down chute prior to dispensing cans from the cartridge.
Figure 6:
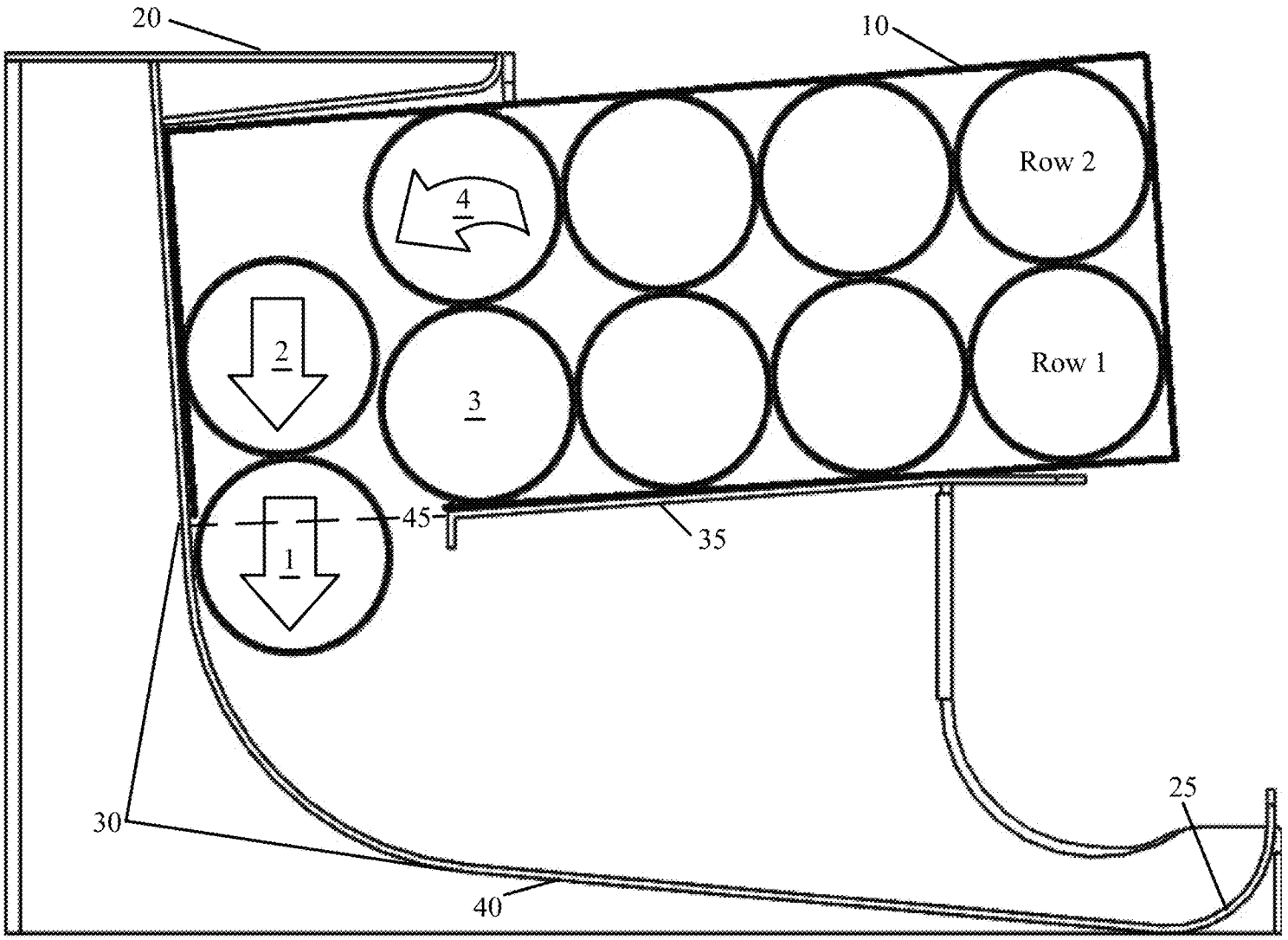
FIG. 6 PRIOR ART
FIG. 6 shows a side view of a prior art double row product cartridge at the start of a typical dispensing sequence, with the first cans in each row of product moving toward the prior art dispenser down chute.
Figure 7:
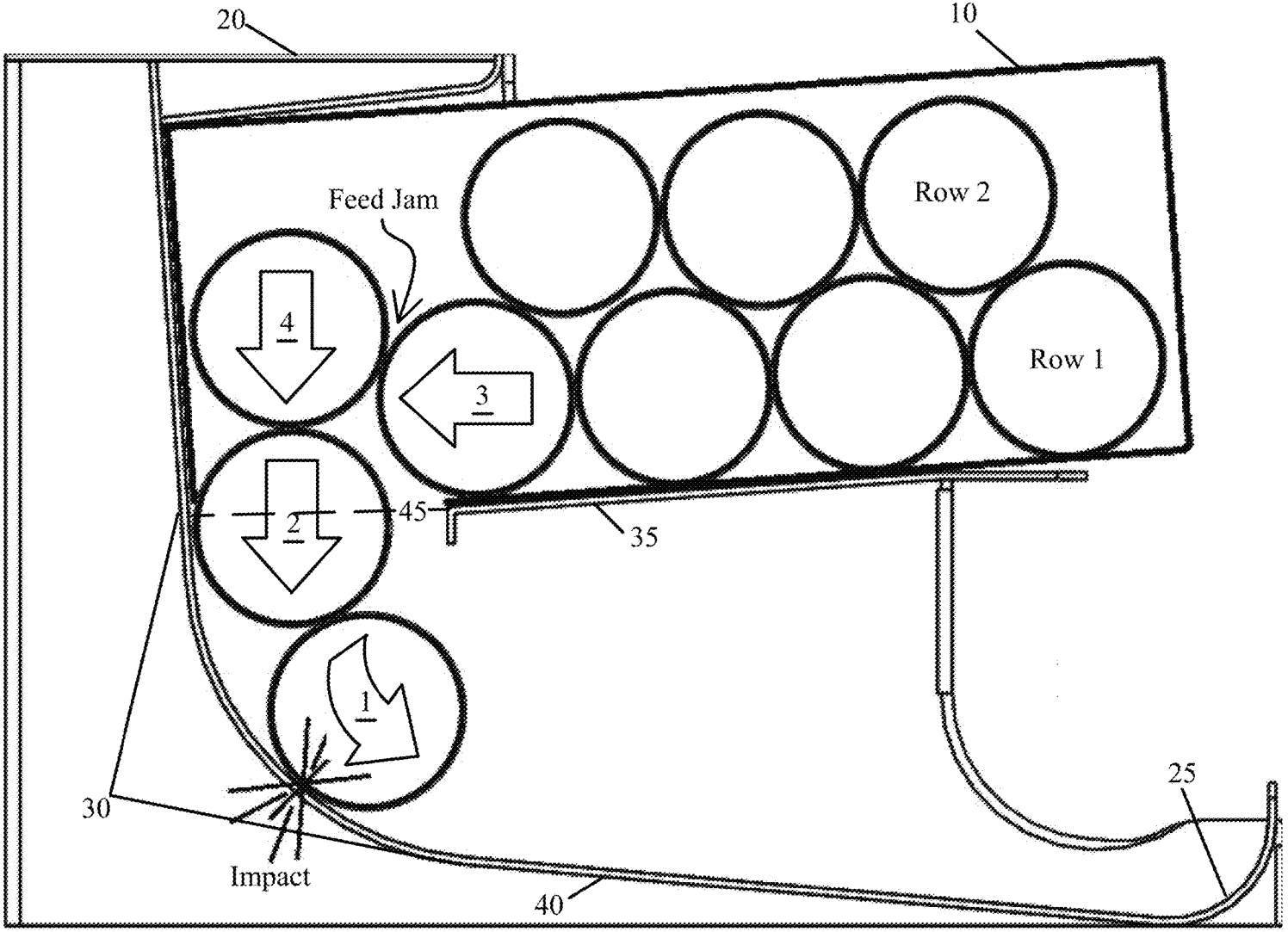
FIG. 7 PRIOR ART
FIG. 7 shows a side view of a prior art double row product cartridge after the first cans in each row of product have entered the prior art dispenser down chute, and the second can of the second row has started to move toward the down chute.
Figure 8:
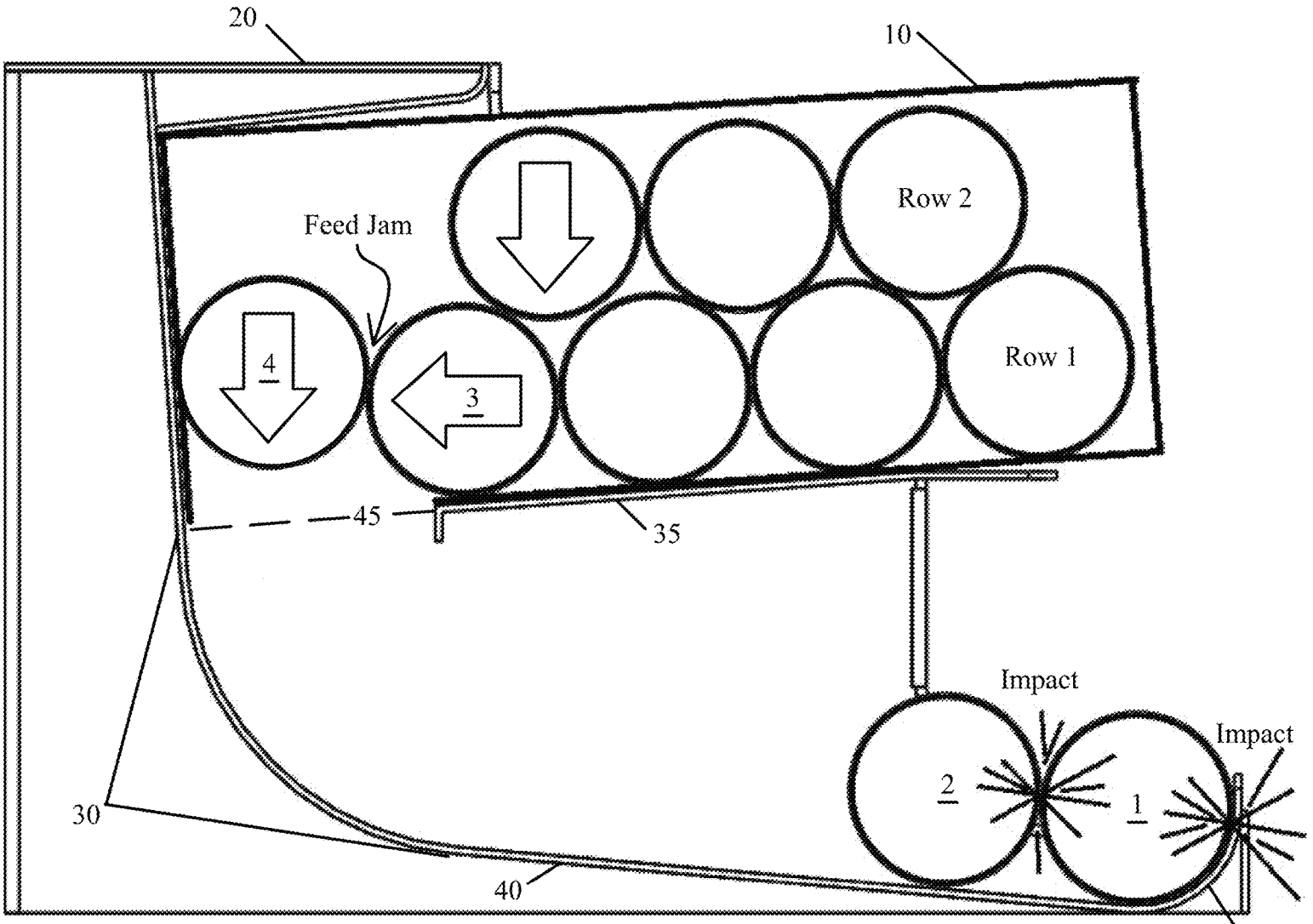
FIG. 8 PRIOR ART
FIG. 8 shows a side view of a prior art double row product cartridge in which the second can of the second row of product contained in the cartridge has caused a feed jam inside the cartridge.
Figure 9:
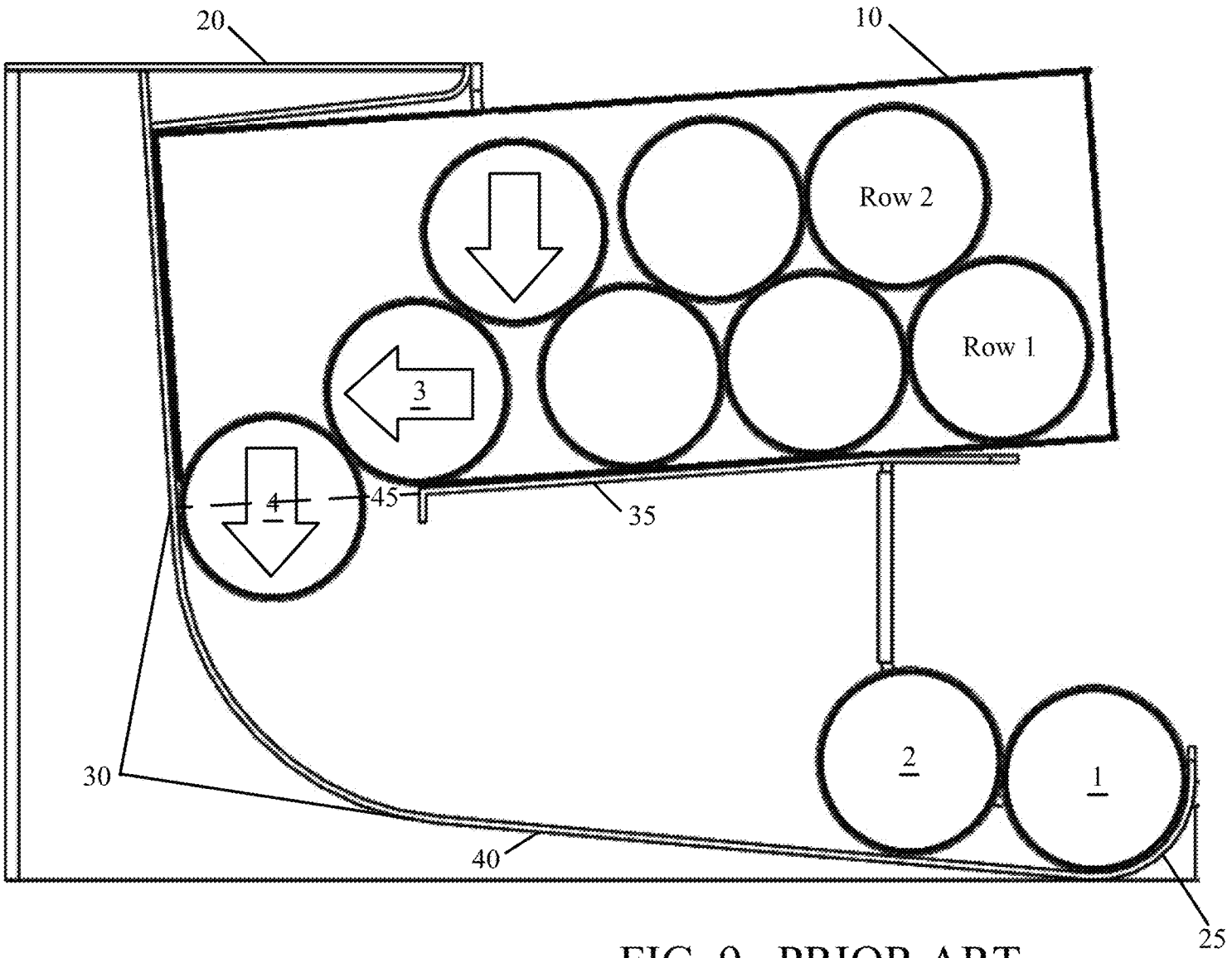
FIG. 9 PRIOR ART
FIG. 9 shows a side view of a prior art double row product cartridge in which the feed jam inside the cartridge has been cleared and the second can in the second row of product in the cartridge has moved into the prior art dispenser down chute.
Figure 10:
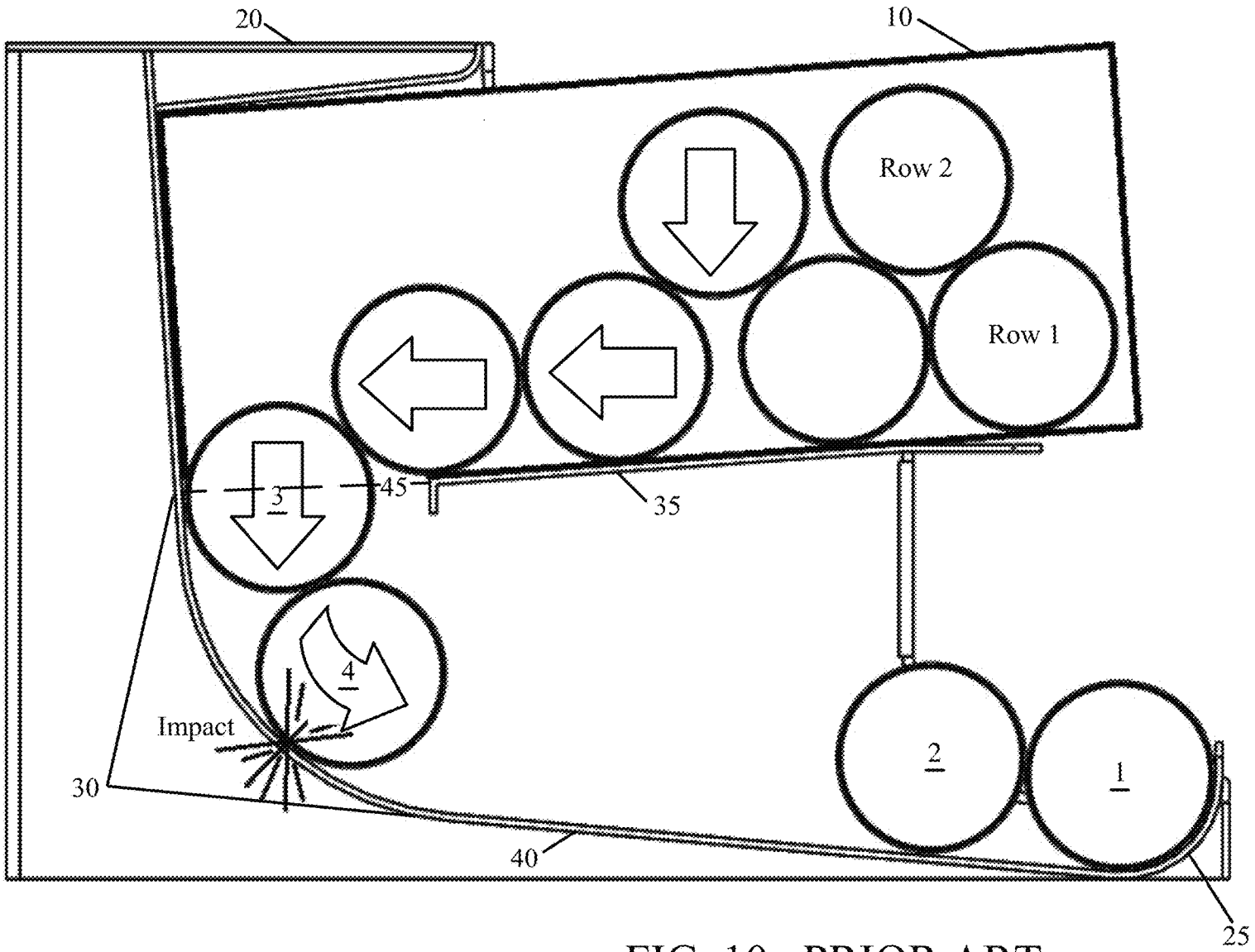
FIG. 10 PRIOR ART
FIG. 10 shows a side view of a prior art double row product cartridge in which the feed jam inside the cartridge has been cleared and the second can and third can in the first row of product in the cartridge are free to feed normally into the prior art dispenser down chute.
Figure 11:
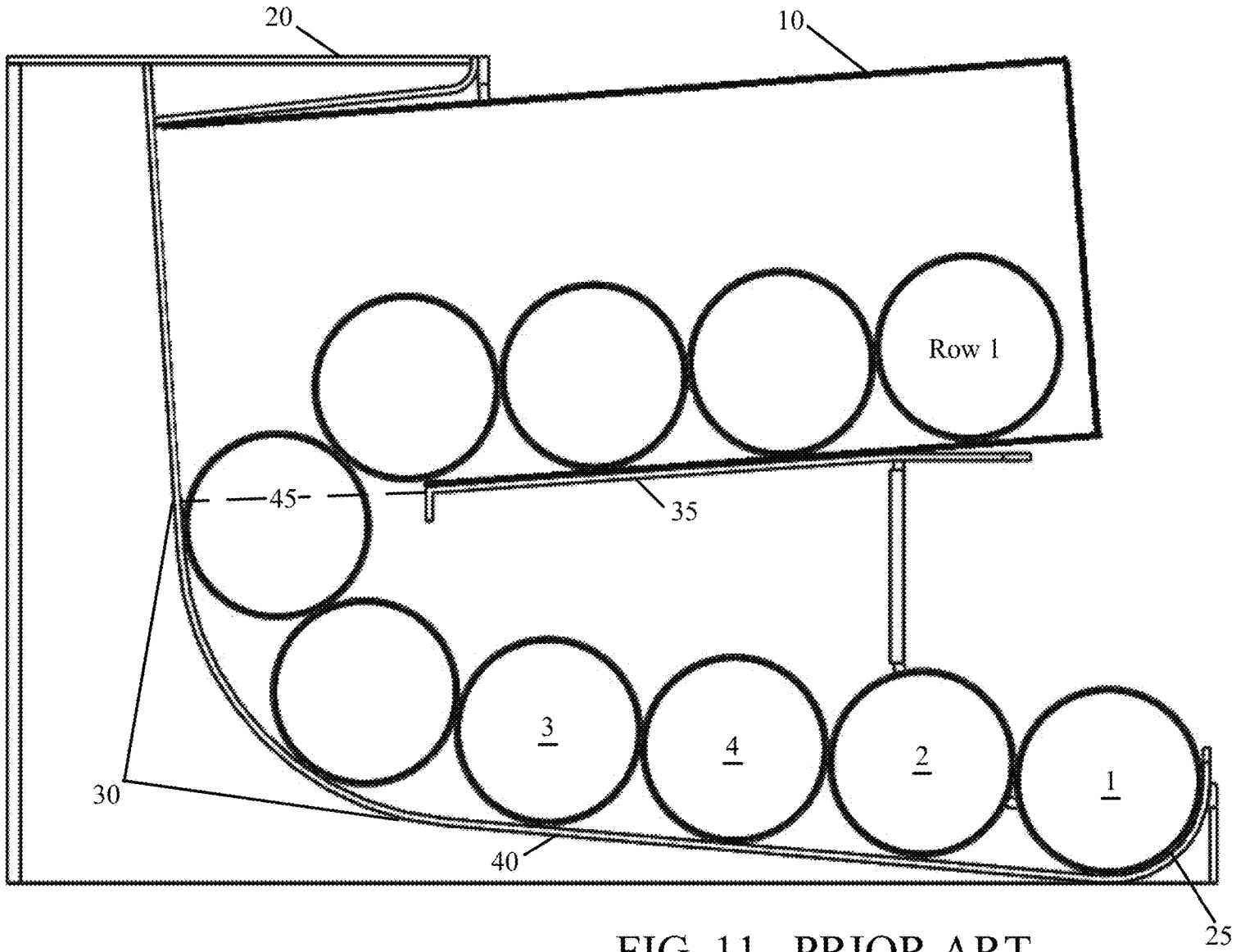
FIG. 11 PRIOR ART
FIG. 11 shows a side view of a prior art double row product cartridge in which the lower feed ramp of the prior art dispenser has been filled with cans, and the cans remaining in the cartridge are free to feed normally.

Previous dispenser 20 and packaging design efforts have reasonably assumed that cans would, as shown for example in prior art FIG. 5, exit a cartridge 10 in the numbered order according to their starting location in a cartridge 10; first can 1, then can 2, then can 3, and then can 4. Various past trial and error attempts to solve product jamming issues were unsuccessful because the cartridges 10 are made from opaque paperboard and it is impossible to see the movement and interactions of the cans 1, 2, 3, 4 inside them. Utilizing a dispenser 20 and cartridge 10 of transparent material it has been found that cans 1, 2, 3, 4 are actually naturally biased to exit, as illustrated in FIGS. 23-30, the cartridge 10 in the order: can 1, can 2, can 4, and finally can 3, as can 4 will roll over the top of can 3 before can 3 is able to roll rearward far enough to exit the cartridge 10 through the exit port 45.

Accordingly, the general operational goal of the dispenser described herein is to facilitate the dispenser's natural affinity to have the cans exit in the 1, 2, 4, 3 order, and reliably prevent jamming. To do this, in an easy, simple, elegant, and cost effective manner, it has proven beneficial to impede the rearward movement of can 3, until after can 4 rolls over it and is able to pass by it downwardly into and through the exit port 45. A number of designs have been explored to accomplish this goal, and jam-free feeding embodiments are included herein that are useful for different diameters and weights of canned products.

Figure 1:
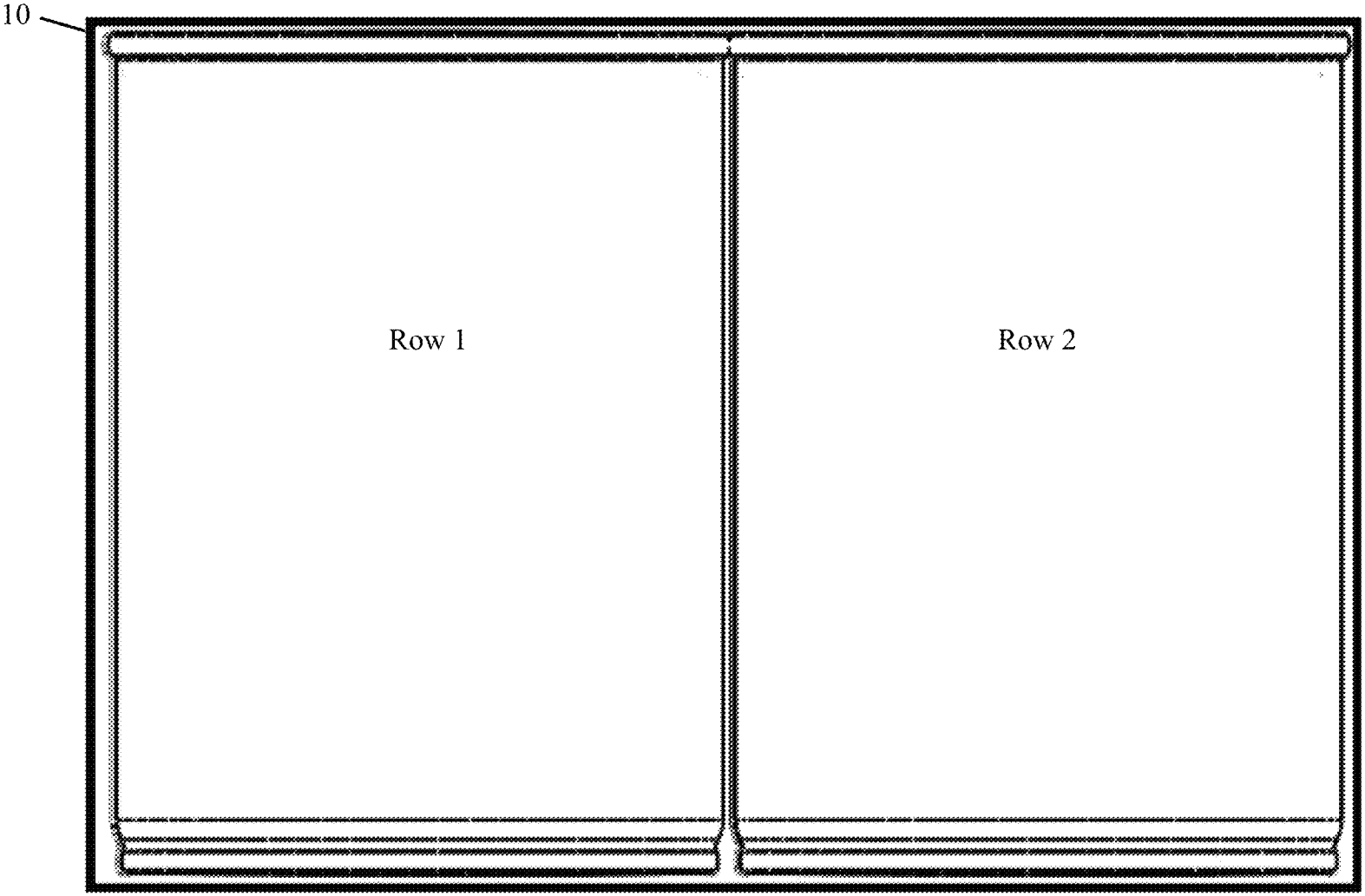
FIG. 1 PRIOR ART
FIG. 1 shows an end view of a prior art double row product cartridge.
Figure 2:
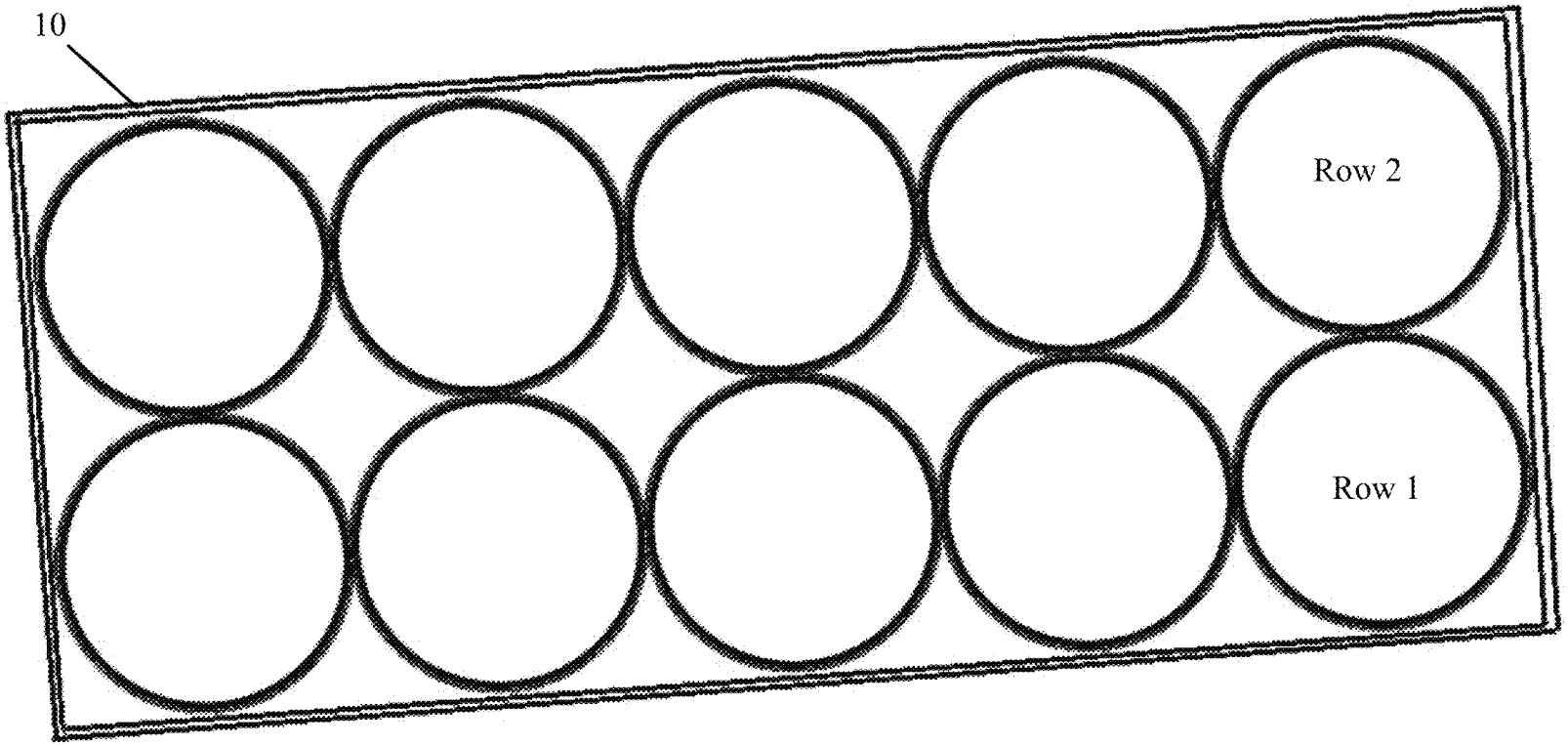
FIG. 2 PRIOR ART
FIG. 2 shows a side view of a prior art double row product cartridge.
Figure 3:
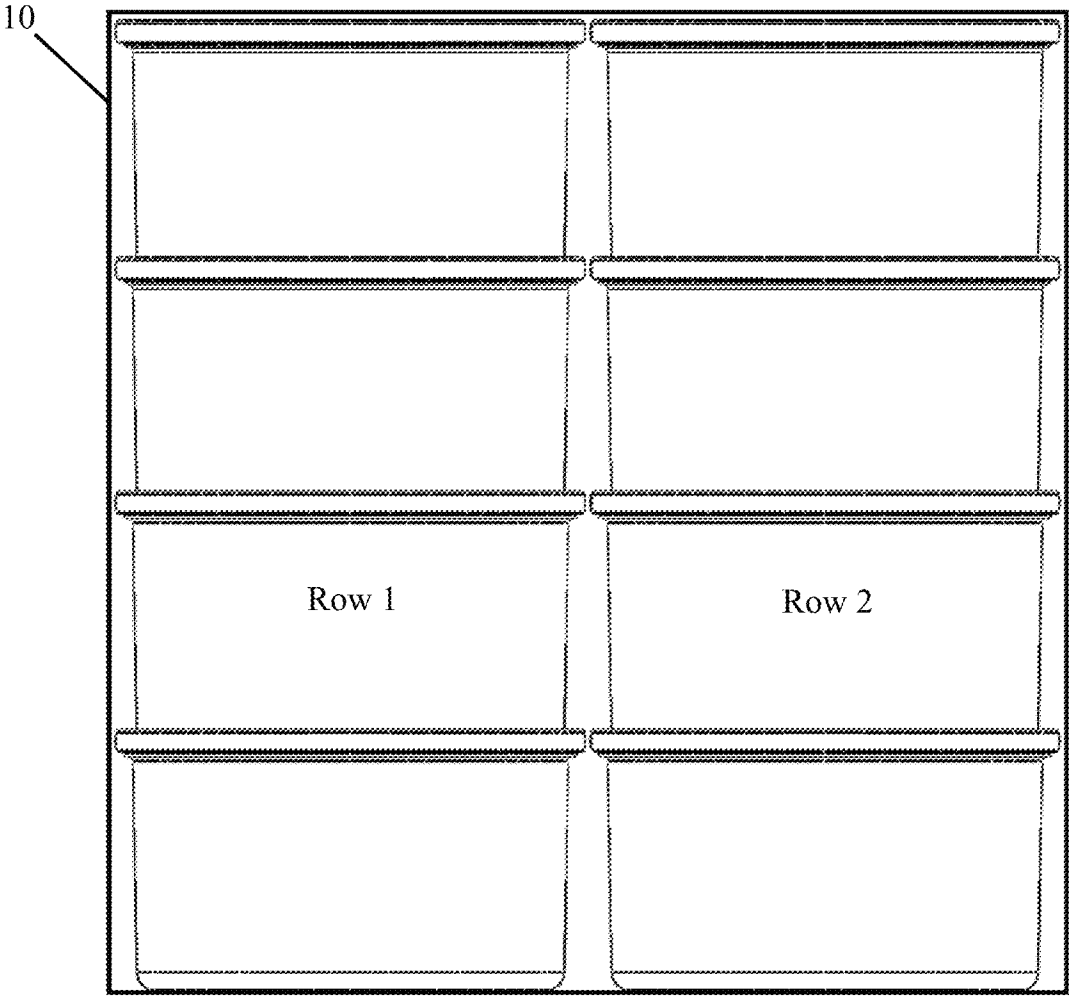
FIG. 3 PRIOR ART
FIG. 3 shows a side view of a prior art stacked double row product cartridge.
Figure 4:
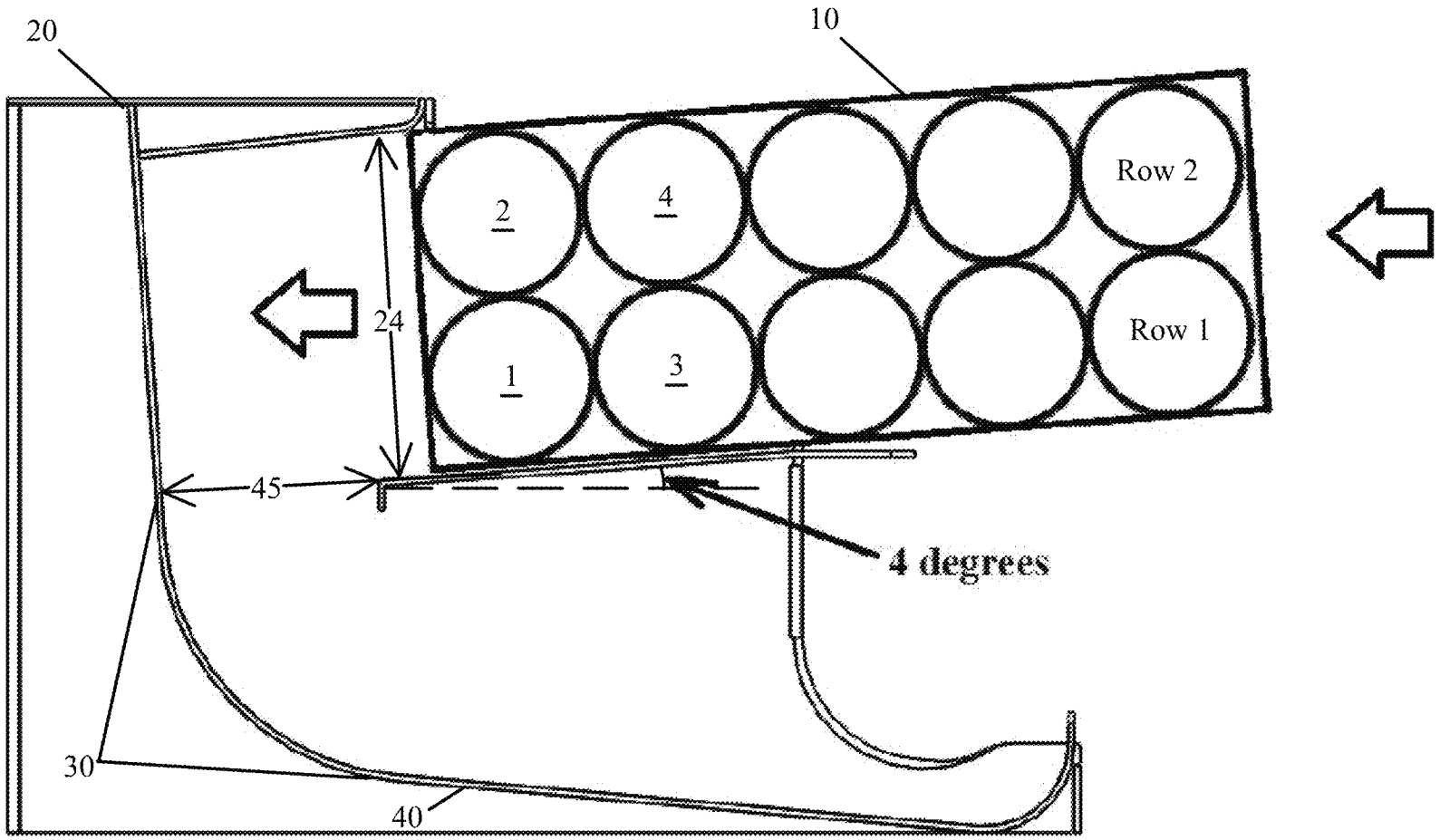
FIG. 4 PRIOR ART
FIG. 4 shows a side view of a prior art double row product cartridge partially inserted in a prior art product dispenser.
Figure 12:
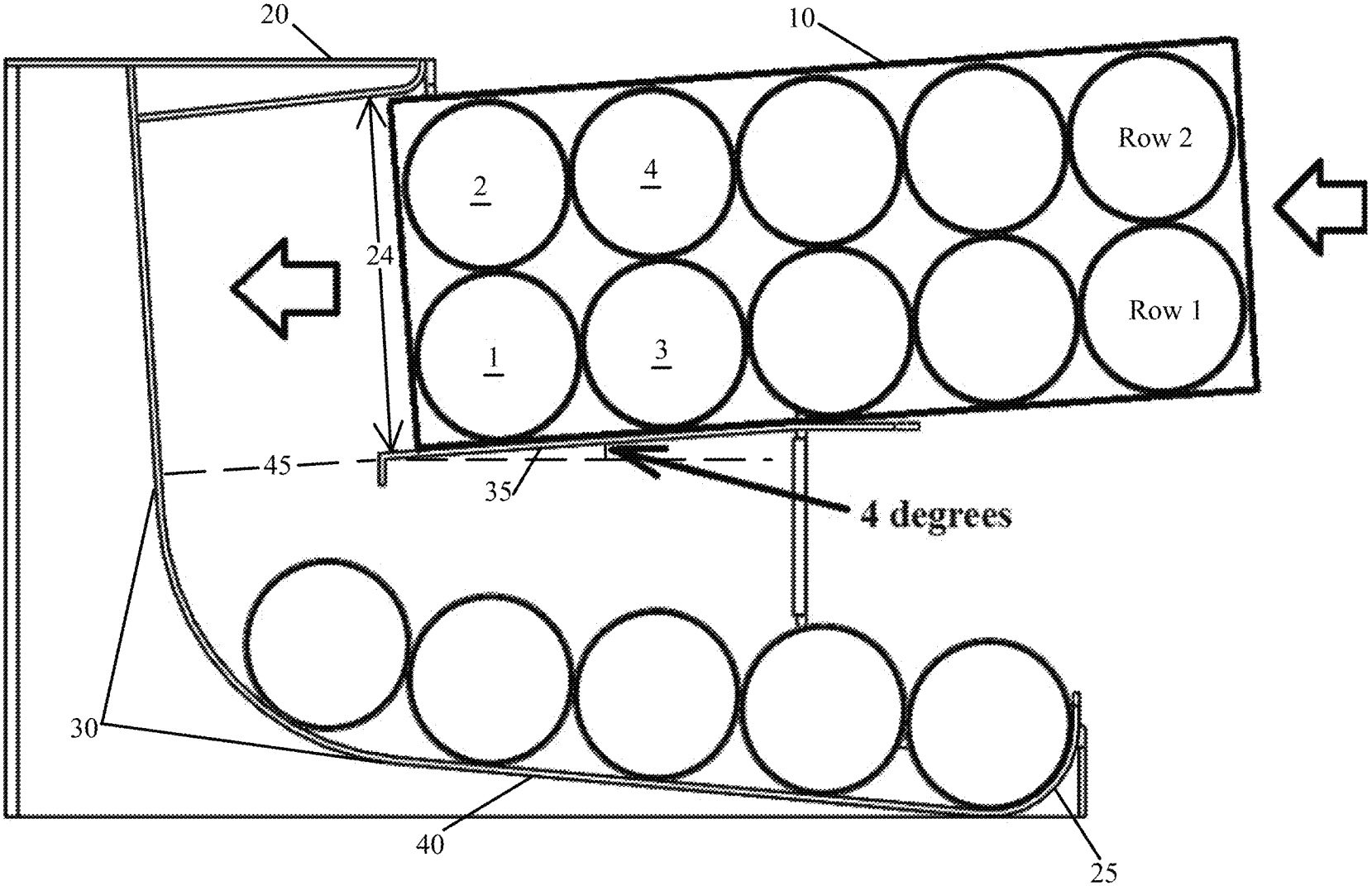
FIG. 12 PRIOR ART
FIG. 12 shows a side view of a full prior art double row product cartridge partially inserted into a prior art dispenser that is partially full.
Figure 13:
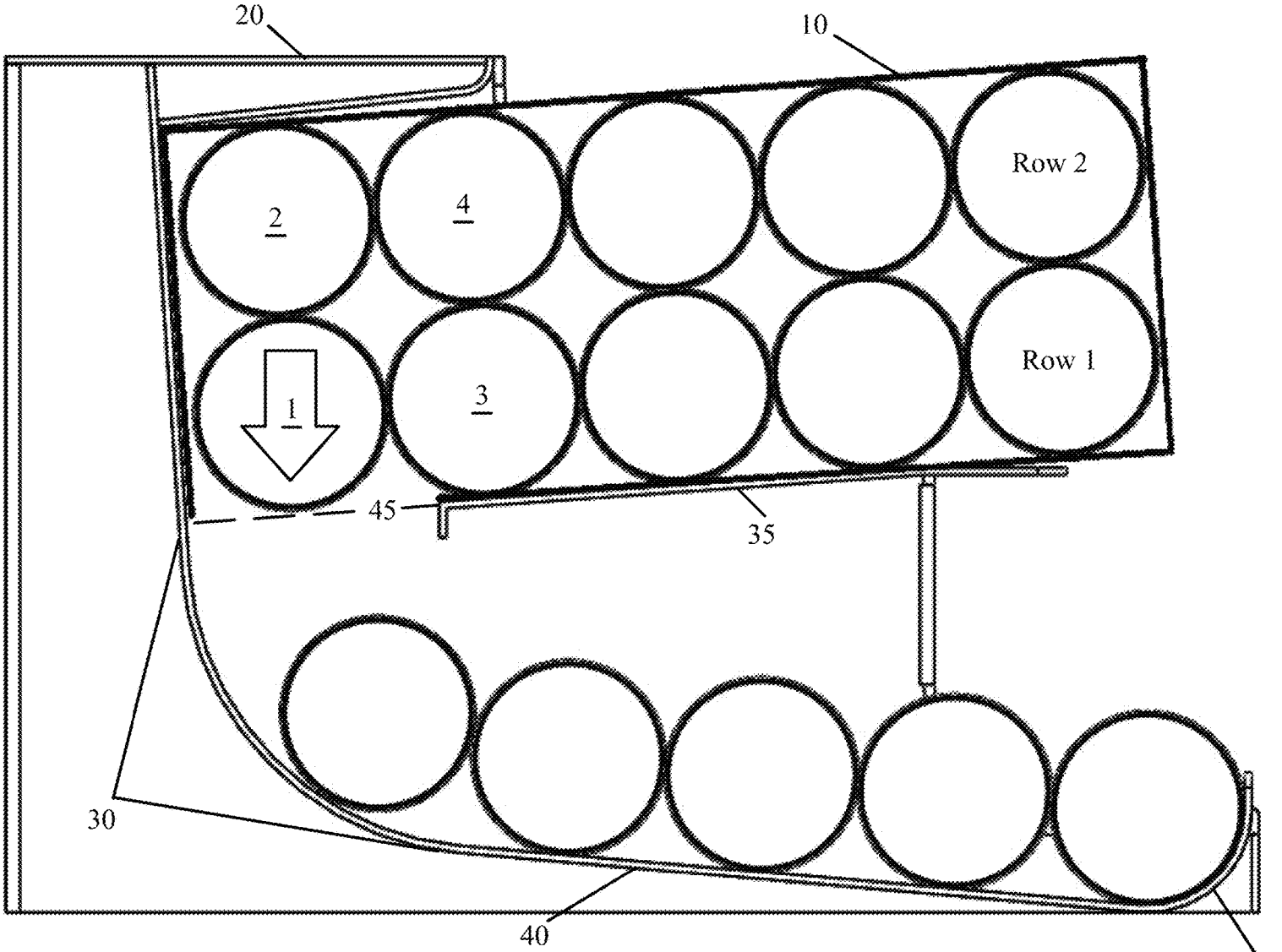
FIG. 13 PRIOR ART
FIG. 13 shows a side view of a prior art double row product cartridge in a prior art dispenser with a down chute and a lower feed ramp partially full of cans prior to dispensing cans from the cartridge.
Figure 14:
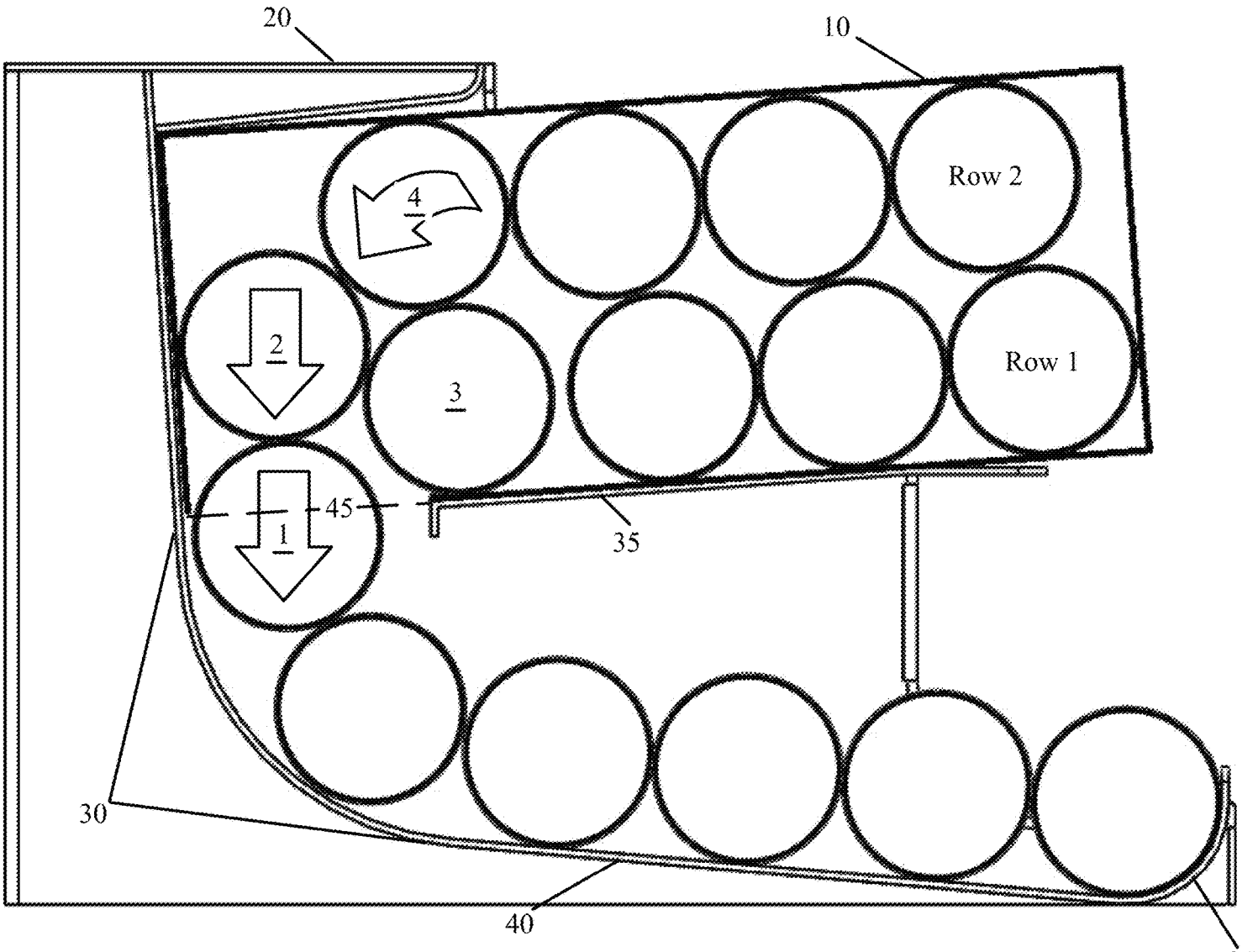
FIG. 14 PRIOR ART
FIG. 14 shows a side view of a prior art double row product cartridge and partially full prior art dispenser, while the first cans in the first and second rows of product in the cartridge move toward the down chute.
Figure 15:
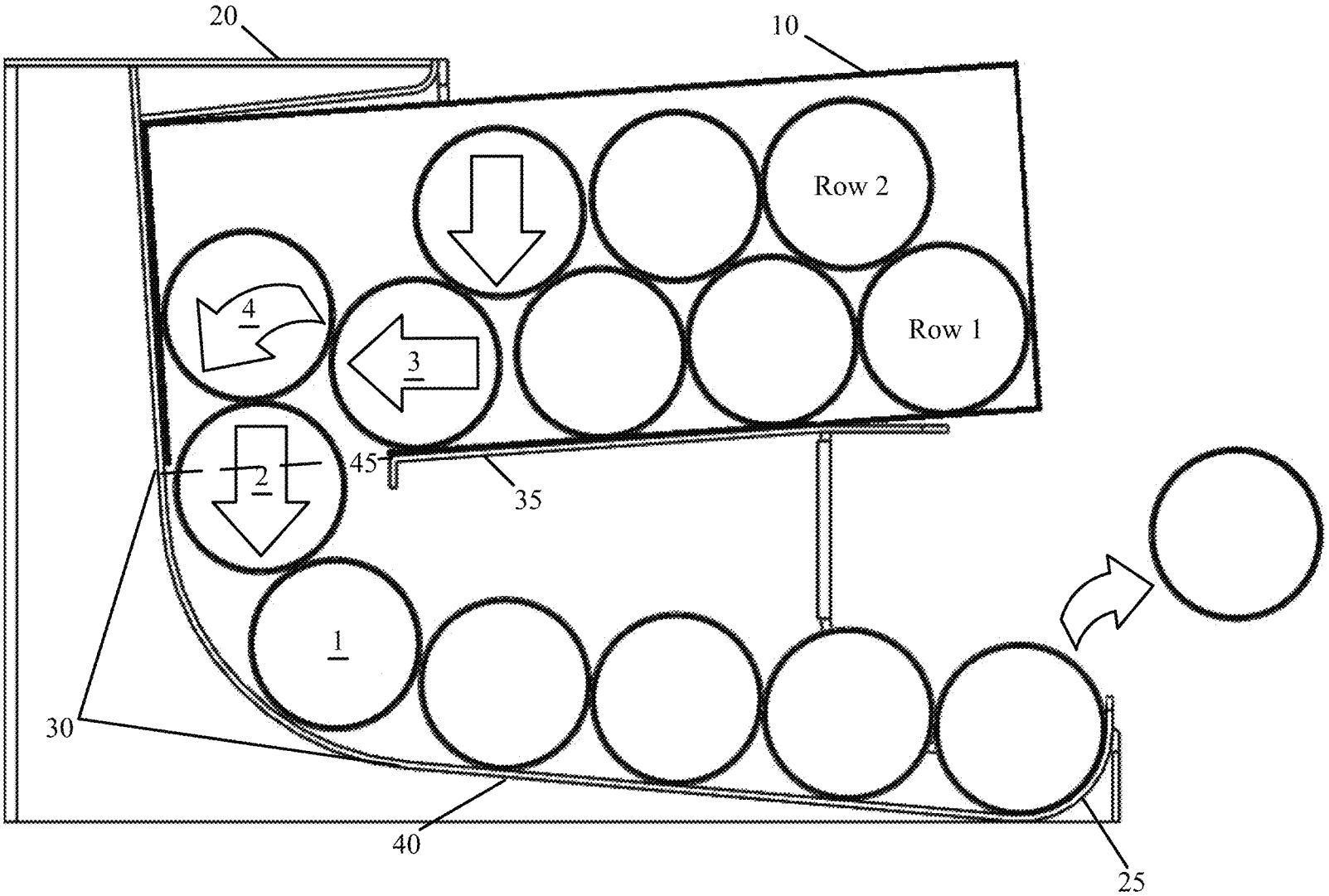
FIG. 15 PRIOR ART
FIG. 15 shows a side view of a prior art double row product cartridge and partially full dispenser and the motion of cans in the cartridge when a can is removed from the product selection area of the prior art dispenser.

Referring to prior art FIGS. 4 and 12, for example, it has been determined through experiments using different loading ramp 35 angles, that a preferable cartridge loading ramp 35 angle of approximately four degrees, up to as much as six degrees, is sufficiently steep to enable cans of some sizes and weights to roll within the cartridge 10, yet maintain the resting inertia of the lower row (Row 1) of cans sufficiently to allow can 4 to roll over the top of can 3 and downwardly toward the exit port 45. However, this specification alone is unreliable for two reasons. First, relying on resting inertia alone causes this solution to be entirely dependent on the size and mass of the rolling products (cans). Large, heavy cans tend to work best with this modification because they possess the right combination of resting inertia and gravitational weight to feed most reliably with this specific loading ramp 35 angle.

Figure 16:
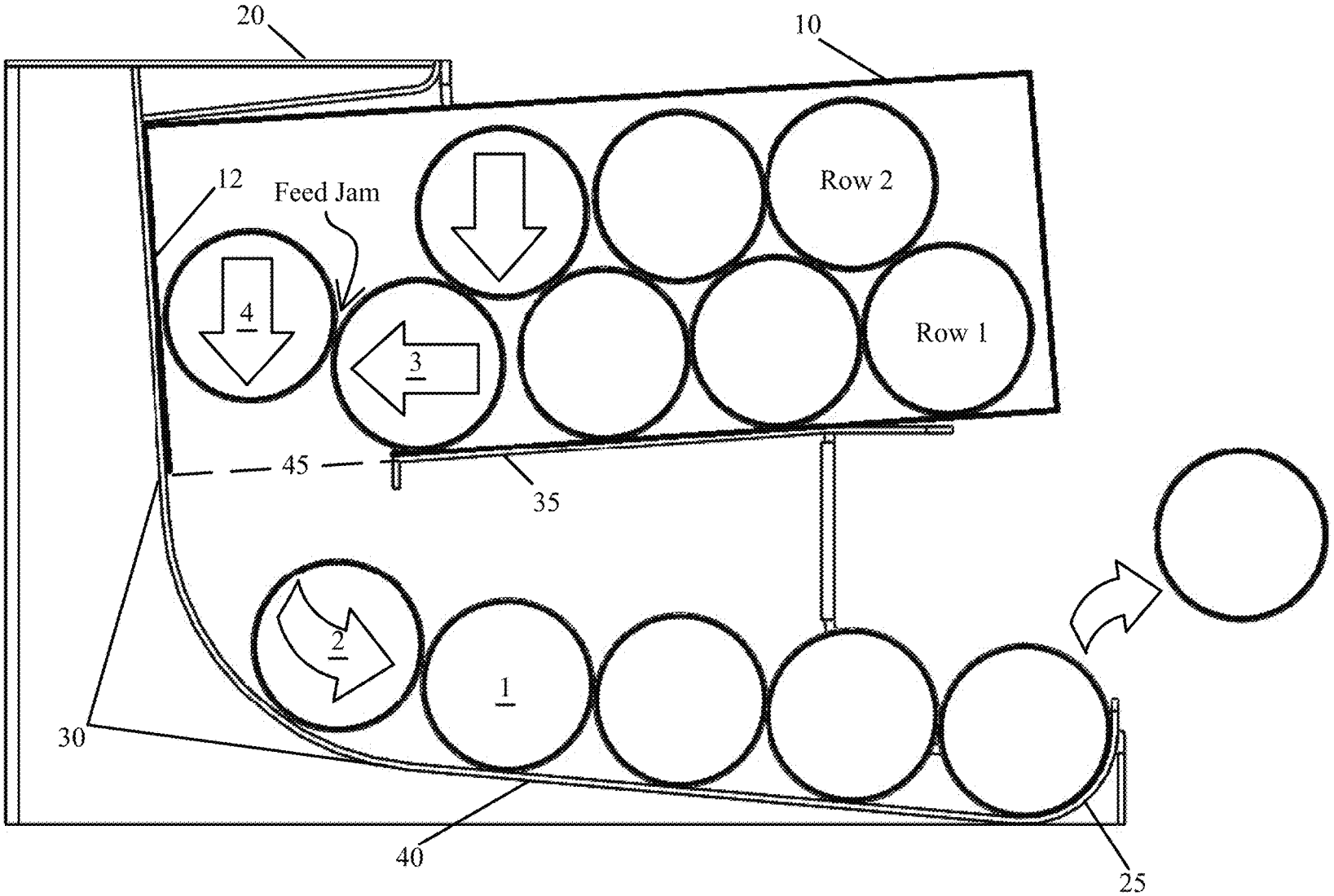
FIG. 16 PRIOR ART
FIG. 16 shows a side view of a prior art double row product cartridge in which the second can of the second row of product contained in the cartridge has caused a feed jam inside the cartridge.
Figure 17:
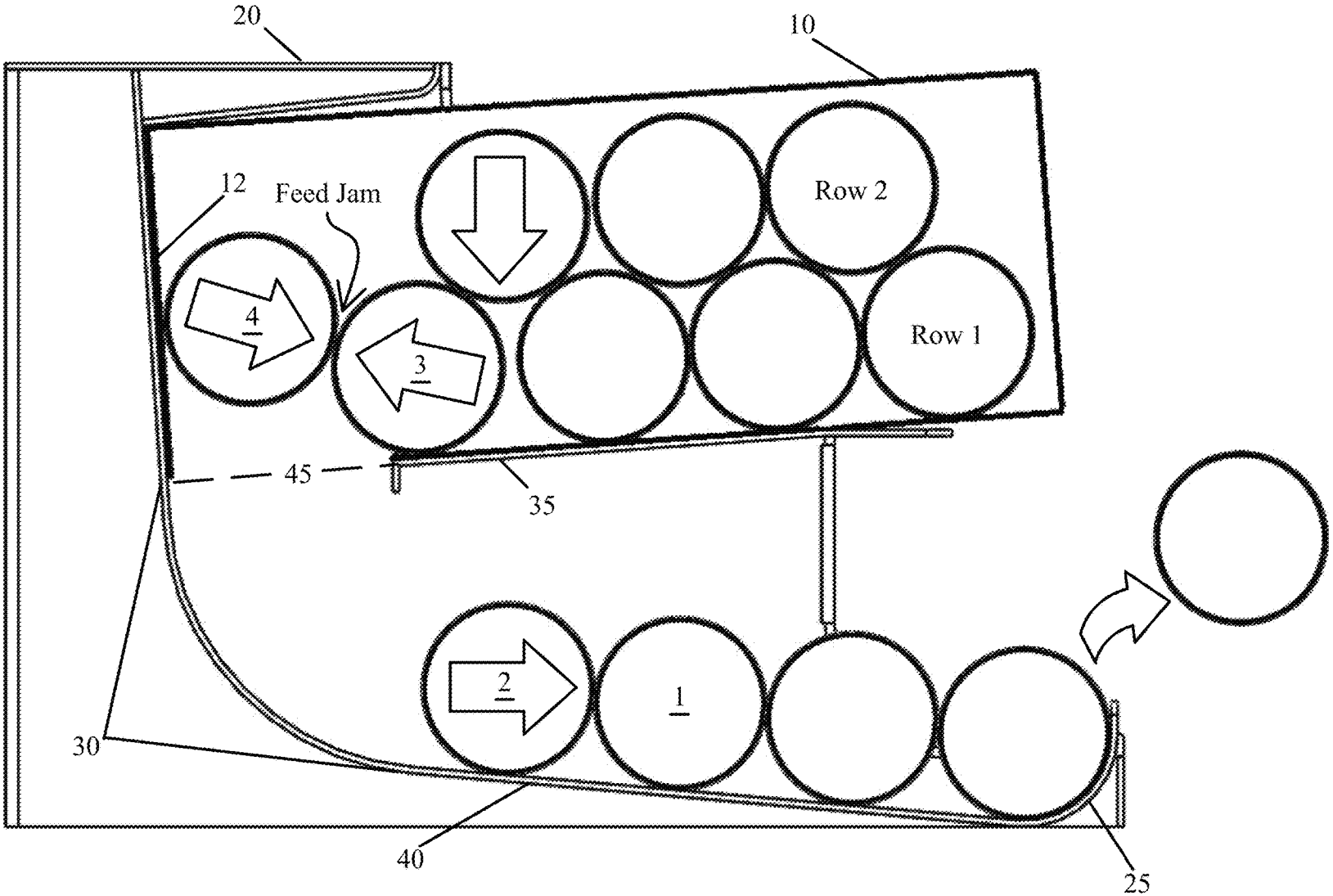
FIG. 17 PRIOR ART
FIG. 17 shows a side view of a prior art double row product cartridge in which the second can of the second row of product contained in the cartridge causes a feed jam inside the cartridge even as product is dispensed from a product selection area.
Figure 18:
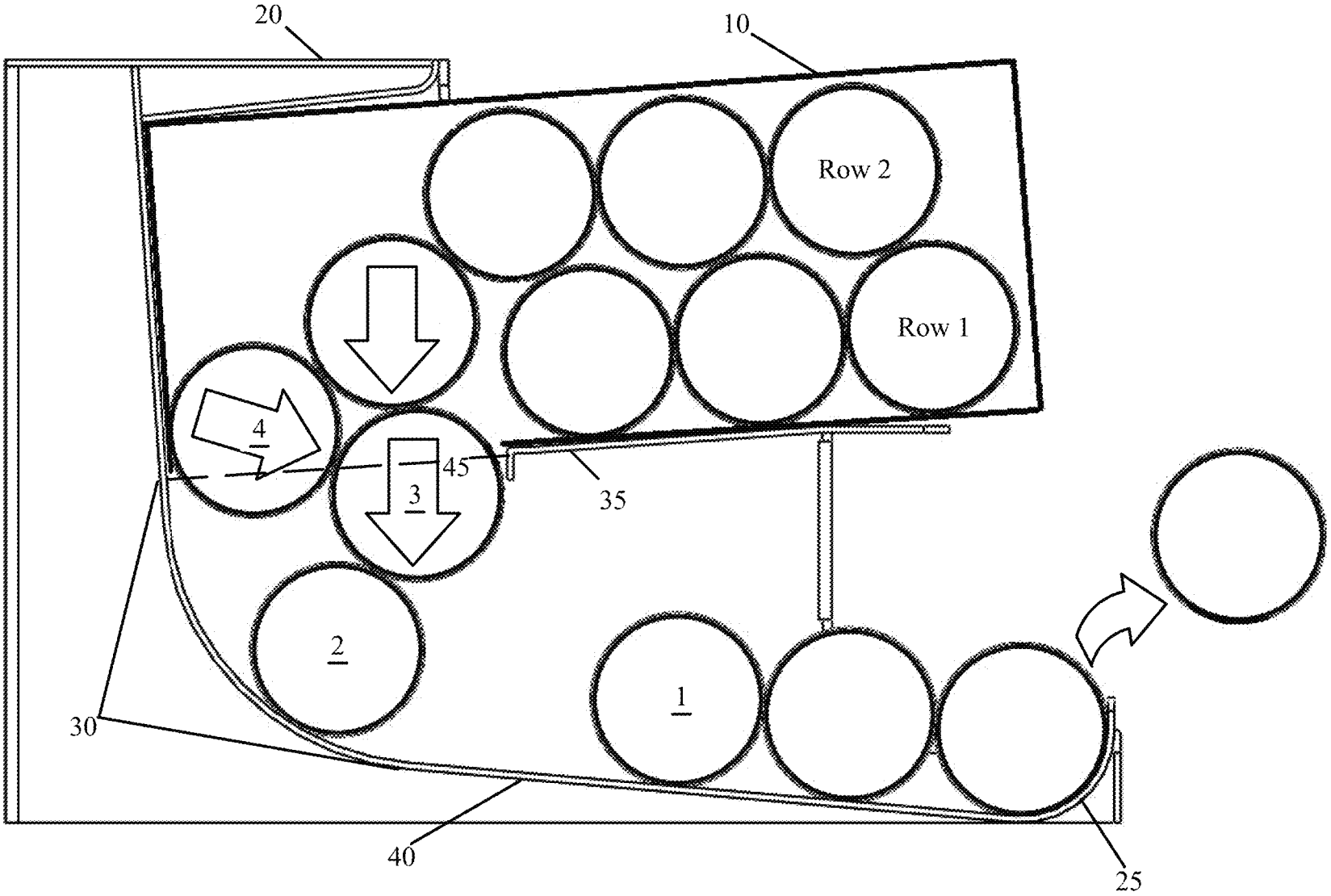
FIG. 18 PRIOR ART
FIG. 18 shows a side view of a prior art double row product cartridge in which product contained in the cartridge causes a feed jam inside the dispenser when the size of the exit port is increased.

On the other hand, as rolling products (cans) become smaller and/or lighter, they are more likely to still jam with this solution alone, because the force of gravity on can 2 and/or 4 is insufficient to overcome the rearward rolling force of can 3 and the balance of the lower row (Row 1) of cans. As a result, as shown in prior art FIGS. 16-17, occasionally can 4 still becomes wedged between can 3 and the rear wall 12 of the cartridge 10. Can 4 is slightly impeded in this case and any vibration at all, such as created by the first two cans 1, 2 impacting and transiting the dispenser's 20 down chute 30 and lower feed channel 40, would (as shown in prior art FIGS. 7-11) often, but not always, dislodge can 4 and continue the feeding of all of the cans in the cartridge 10 thereafter. As such, this solution alone is not sufficiently reliable to implement in a commercial setting as it does not completely solve the problems of the prior art. Further when reducing the cartridge 10 loading ramp angle to less than approximately four degrees, the cans fail to overcome friction and do not roll within the cartridge 10, while angles steeper than approximately eight degrees worsen jamming, and increase dispenser height thus unnecessarily wasting valuable store shelf height space.

Therefore, additional structural changes are implemented to temporarily impede the rearward movement of can 3 and the other cans in the cartridge 10 lower row (Row 1), so that can 4 may reliably exit the cartridge 10 ahead of can 3. By using the loading ramp 35 angle of approximately four to six degrees and modifying the shape of the dispenser 20 down chute 50, as shown in FIGS. 20A-22, into what can substantially be described as an "S"-shape, cans 1 and 2 naturally align themselves in the down chute 50 and impede, as shown in FIGS. 23-27, the rearward movement of can 3 in a controlled manner.

Figure 19:
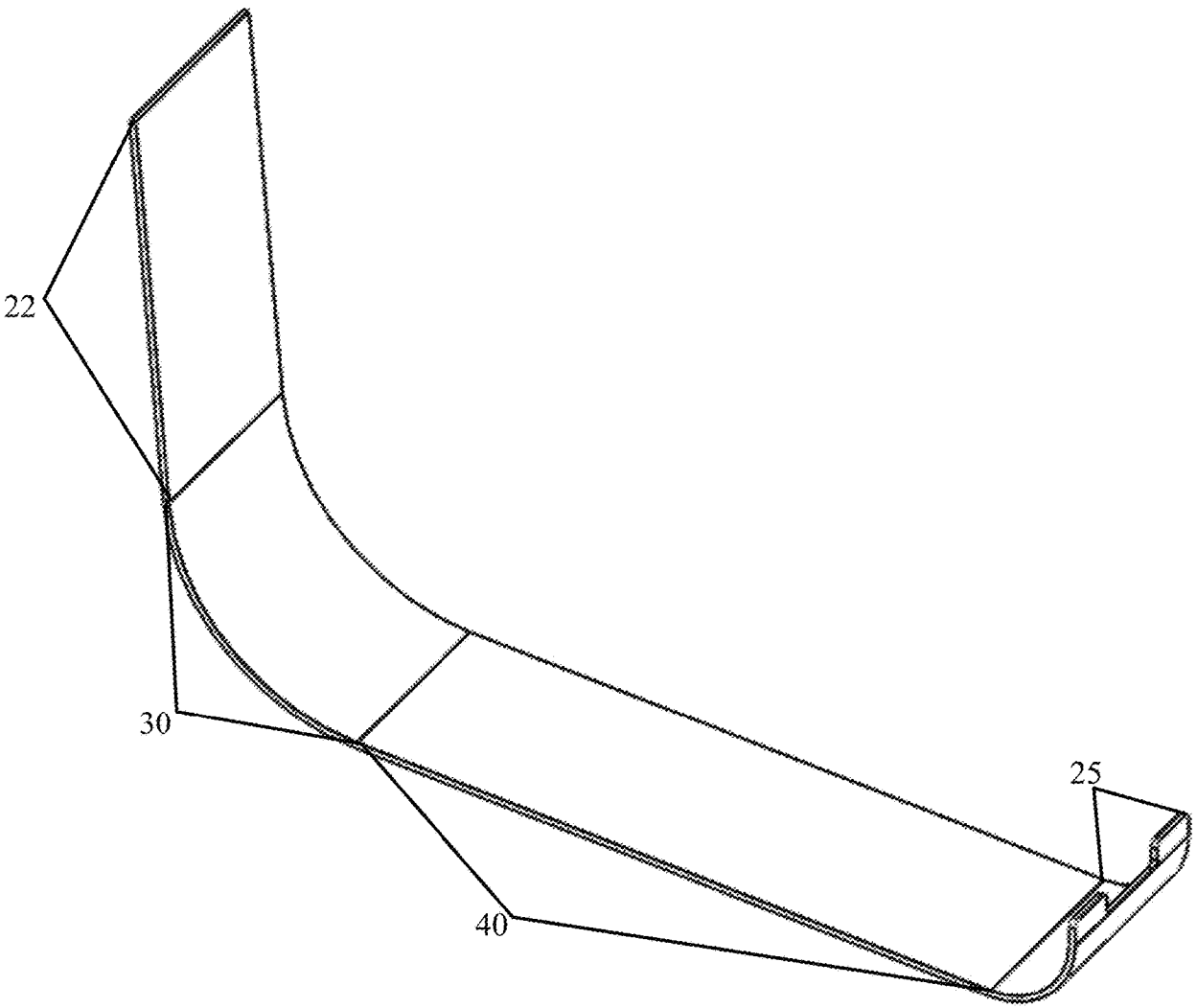
FIG. 19 PRIOR ART
FIG. 19 shows a perspective view of a prior art down chute and loading ramp.
Figure 21:
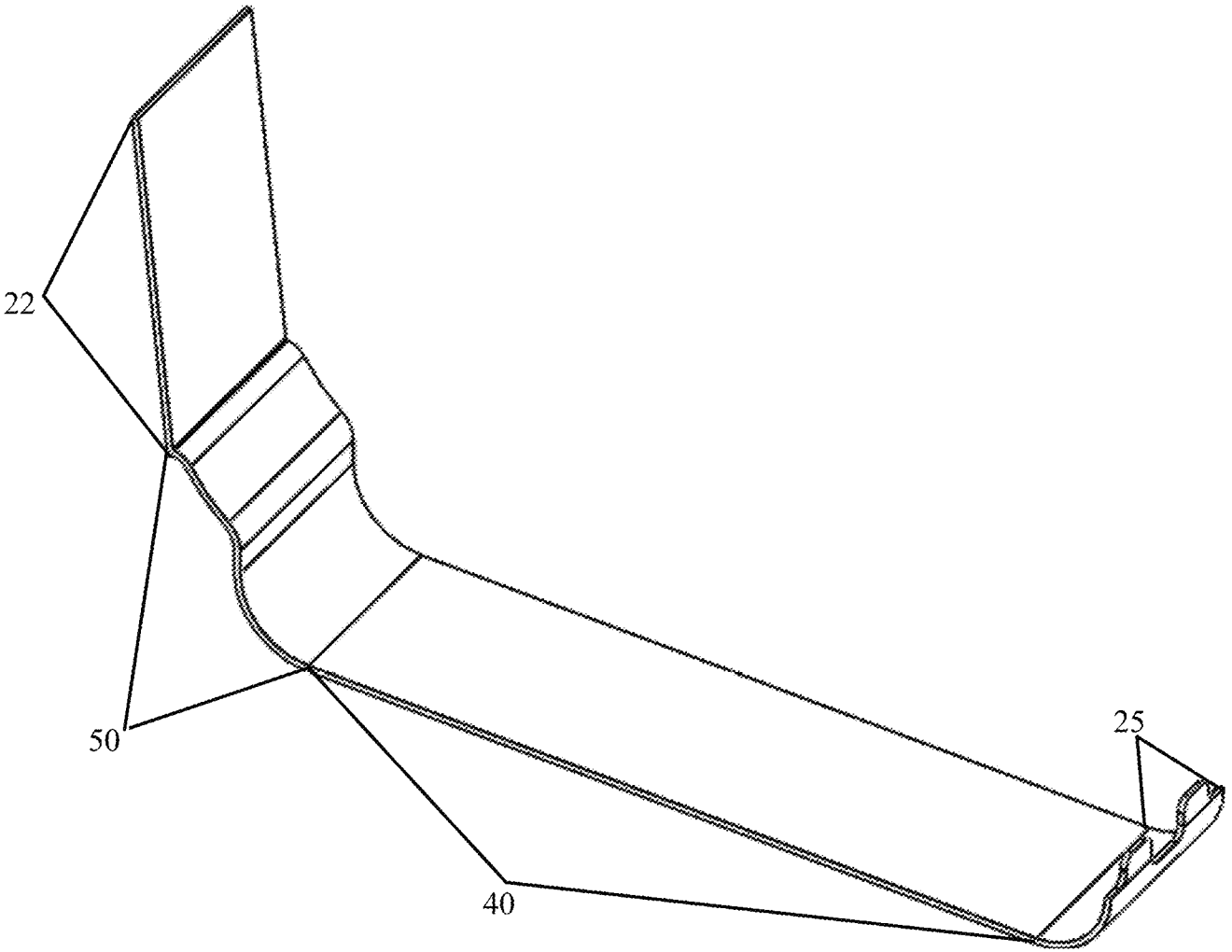
FIG. 21 shows a perspective view of a substantially "S" shaped down chute and lower feed ramp.
Figure 22:
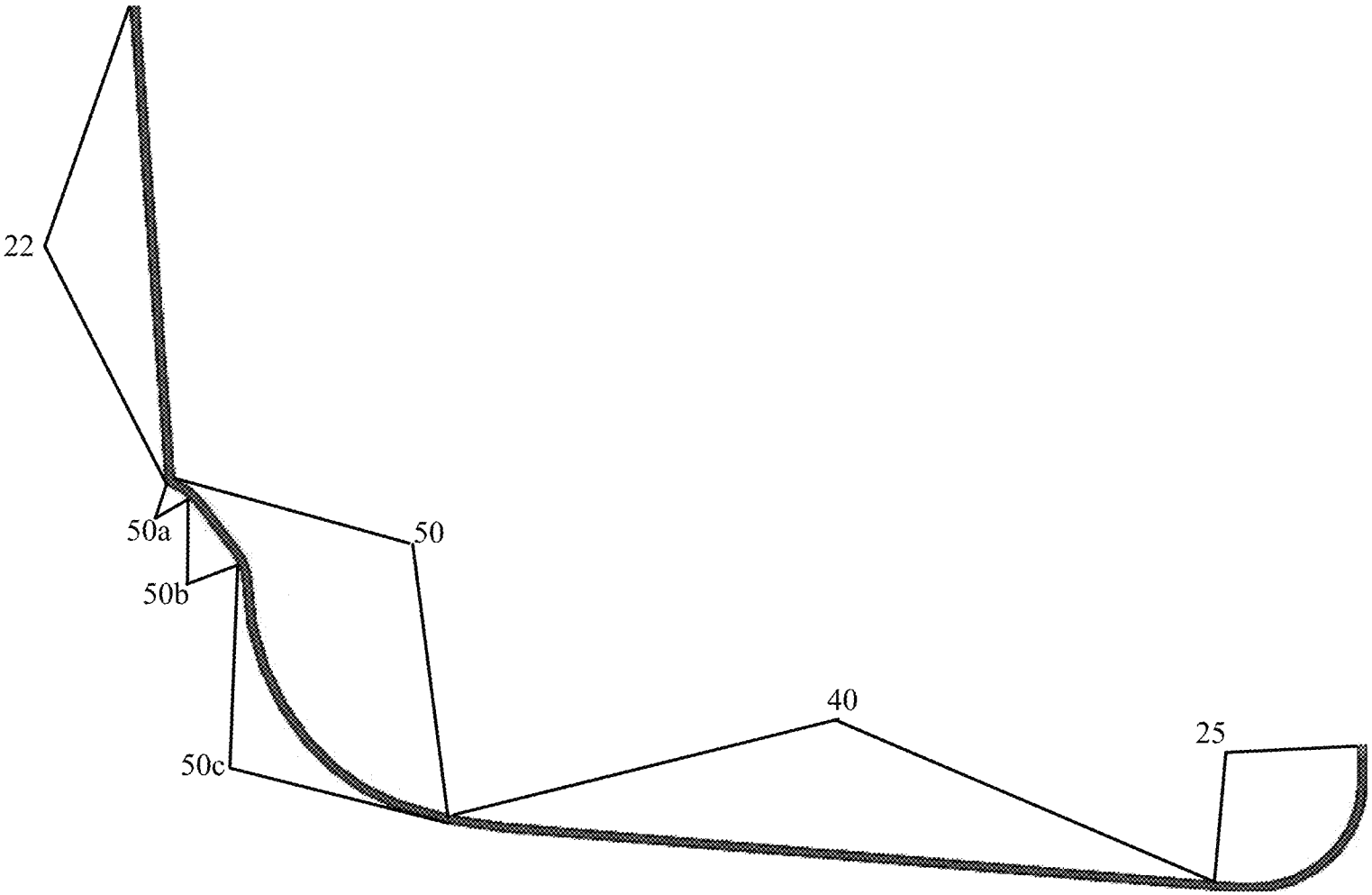
FIG. 22 shows a side view of a substantially "S" shaped down chute and a lower feed ramp.

Prior art FIG. 19 shows typical dispenser 20 elements that are disposed between the side walls of a dispenser 20, and define a dispenser 20 back wall 22, a down chute 30, lower feed ramp 40, and a product selection area 25 within the dispenser 20. Such a down chute 30 contributes significantly to product feed jams as described herein. Referring to FIGS. 21 and 22, an improved down chute 50 is shown along with a dispenser 20 back wall 22, lower feed ramp 40, and product selection area 25.

Figure 31:
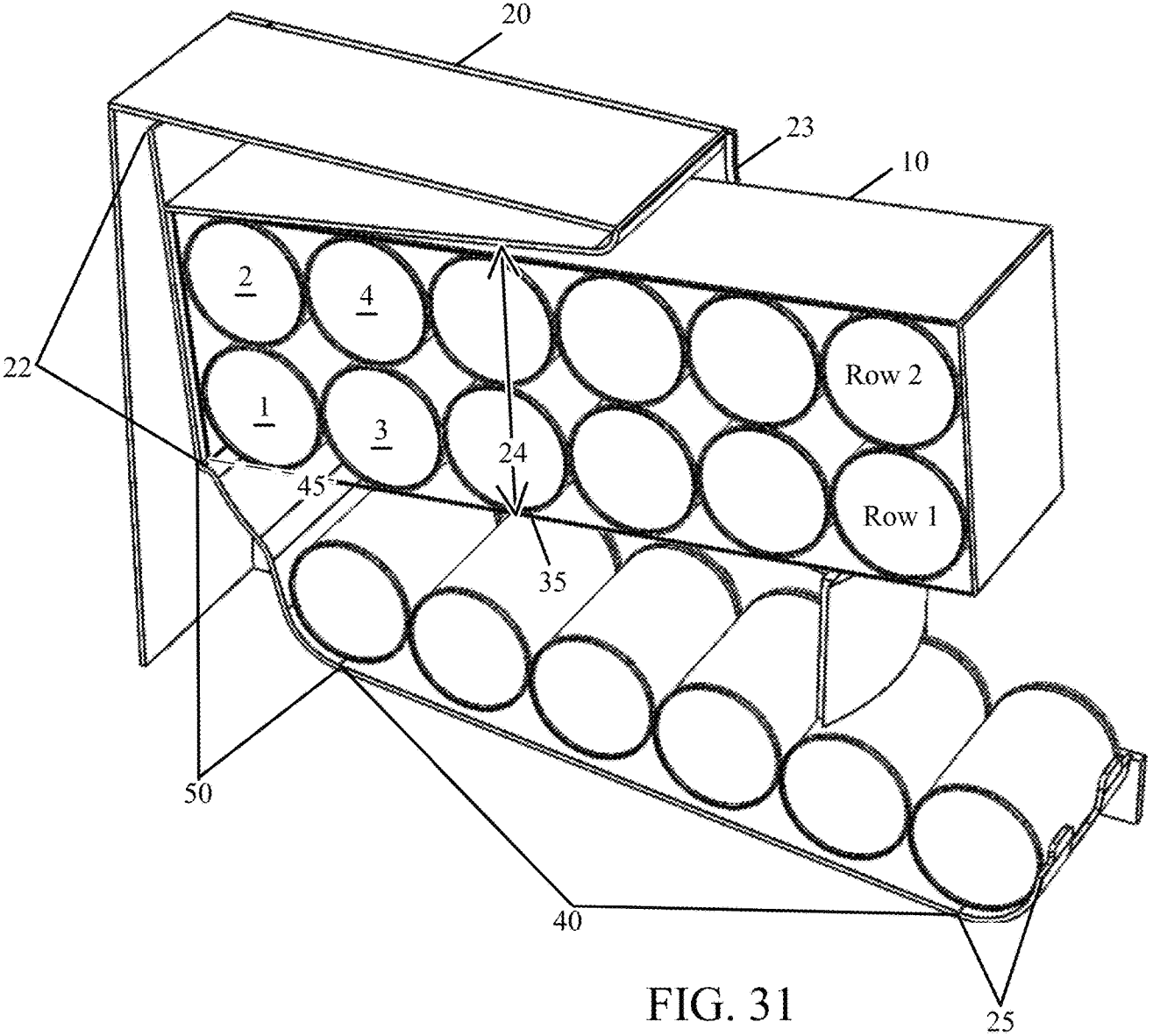
FIG. 31 shows a perspective and partial cut away of one embodiment of a substantially "S" shaped down chute and a lower feed ramp within a product dispenser holding a product cartridge.

Referring to FIG. 22, the three major sections of the improved down chute 50 are: the upper arcuate section 50*a*, the central arcuate section 50*b*, and the lower arcuate section 50*c*. FIG. 31 shows the improved down chute 50 in a dispenser 20 in relation to other dispenser 20 elements such as the loading ramp 35, far side wall 23 (near side wall not shown for clarity), the back wall 22, the lower feed ramp 40, the cartridge holding area 24, the product selection area 25, and a cartridge 10 containing two rows of cans (Lower Row 1 and Upper Row 2).

Figure 20A:
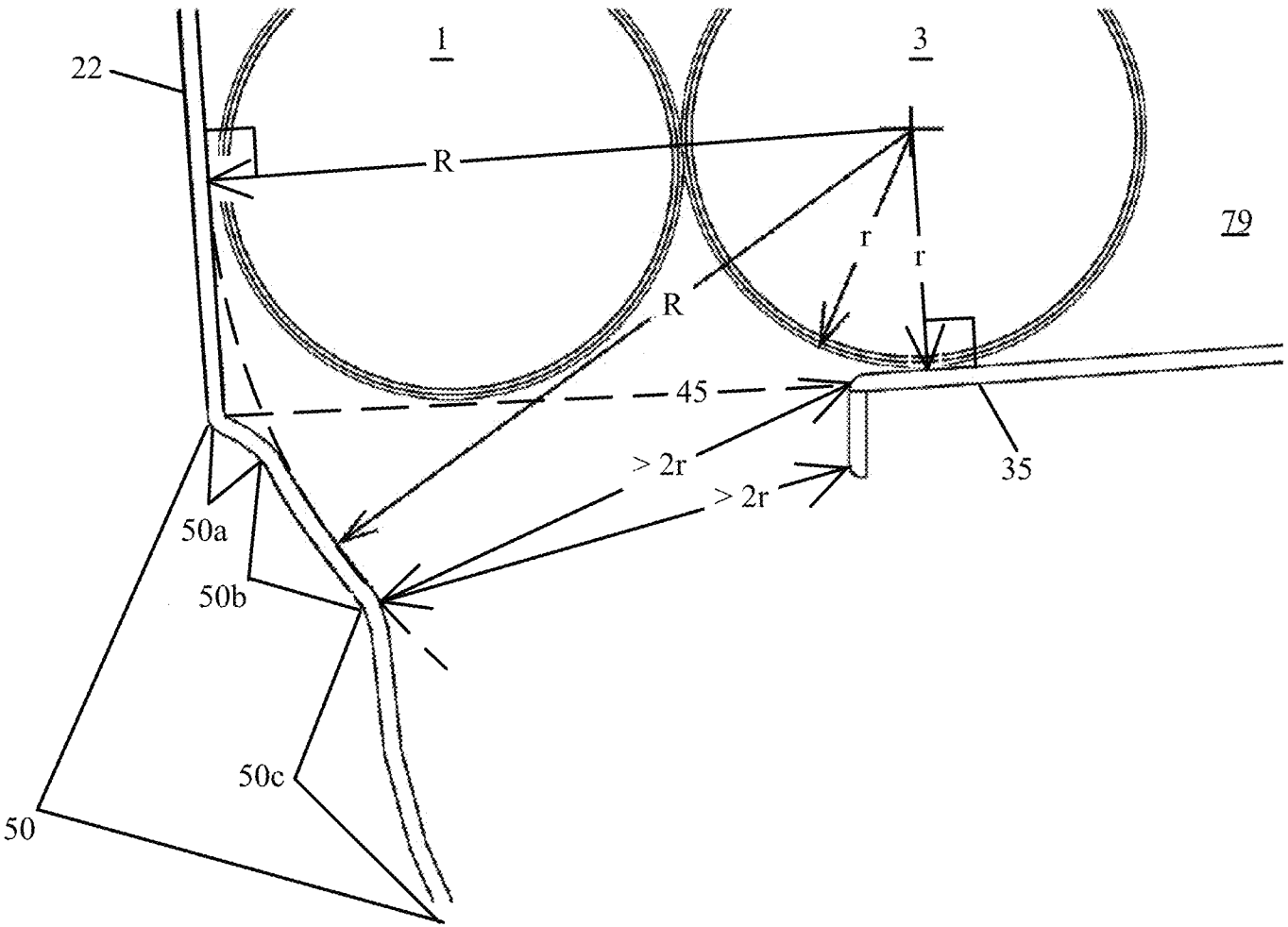
FIG. 20A shows a side view of a substantially "S" shaped down chute and loading ramp with down chute geometry.

Referring to FIG. 20A, the improved down cute 50 is formed from three arcuate sections 50*a*, 50*b*, 50*c*, connected by generally arcuate transitions. The upper most arcuate section 50*a* has a convex curvature toward the front and top of the dispenser 20. The central arcuate section 50*b* and lower arcuate section 50*c* have concave curvatures away from the top and front of the dispenser 20. Together, the three arcuate sections 50*a*, 50*b*, 50*c* form a down chute 50 that is substantially an "S"-curve in shape, wherein the central arcuate section 50*b* of the "S" substantially forms a saddle along with its connections to adjacent arcuate sections 50*a*, 50*c*.

The central arcuate section 50*b* has a concave radius of curvature, "R", that is preferably slightly larger than three times the radius, "r", of one of the cans, for example can 3, in the cartridge 10 to direct movement of the cans 1, 2, 3, 4 as they transit the down chute 50. This embodiment is also applicable to dispensers 20 that use a hopper volume 79, FIG. 20A, for bulk storage of cans rather than a pre-filled cartridge 10, where the hopper volume 79 is at least the loading ramp 35, dispenser 20 sides 23 and back 22.

Figure 20B:
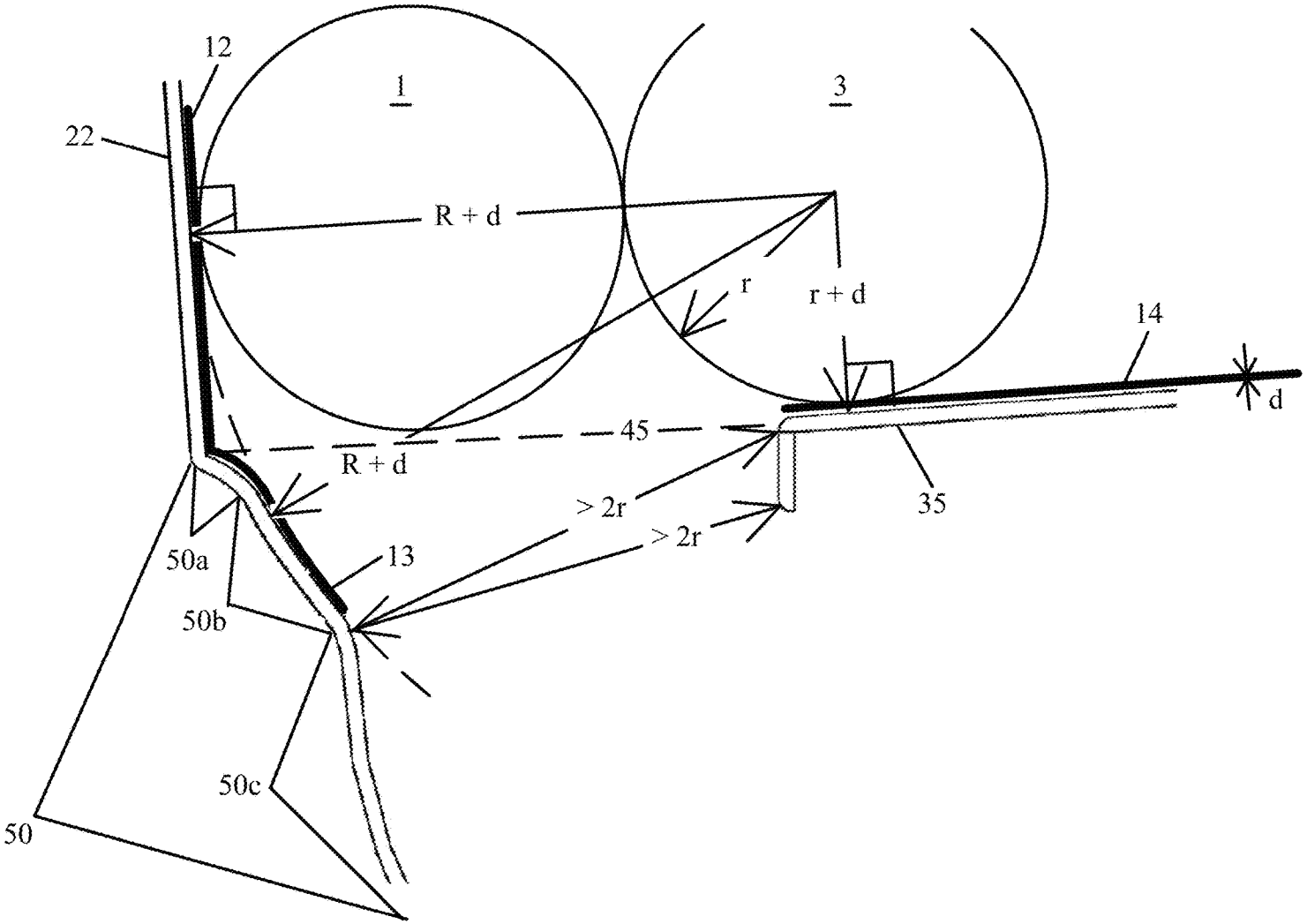
FIG. 20B shows a side view of a substantially "S" shaped down chute and loading ramp with down chute geometry accounting for cartridge material thickness.

As shown in FIG. 20B, additional tolerances "d" can be added to allow for the thickness "d" of any cartridge material 13 (a cartridge 10 opening flap, for example) that may be moved into contact with the "S"-curved down ramp, as well as the thickness of cartridge material along the cartridge bottom 14, and back wall 12.

Referring again to FIG. 20A, the down chute 50 central arcuate section 50*b* forms a surface with a radius of curvature preferably slightly larger than "R" (where R is approximately three times the radius "r" of a single can), with that radius having an origin preferably located a distance "r" perpendicular to, and above, the loading ramp 35, and a distance of "R" perpendicular to, and forward from, the dispenser back wall 22. In other words, the curvature of concave arcuate section 50*b*, as defined by "R", is generally concentric to the curvature of the outermost contact surface of can 3 in its starting position in the cartridge 10.

Shown in FIG. 20B, the radius of curvature "R" of the central arcuate section 50*b* is increased by at least "d", where "d" is the cartridge material thickness accounting for cartridge material, such as a cartridge opening flap 13, extending downward onto the down chute 50, for example.

Generally, the arc length of the central arcuate section 50*b* will vary with can size (diameter) and mass. The arc length is preferably dimensioned so that as can 1 and can 2 transit the exit port 45, can 3 is held stationary long enough for can 4 to pass by it and transit the exit port 45 ahead of can 3. The dimensioning of the arc length at the lower end of the central arcuate section 50*b*, as shown in FIGS. 20A-20B, is such that the central arcuate section 50*b* is preferably maintained, at its extreme forward point, a distance from the rear most and lowest extent of the loading ramp 35 that is greater than one can diameter (>2r). Distances smaller than this value would block can movement through the down chute 50. Additionally, the central arcuate section 50*b* preferably does not become substantially horizontal at its lower extent, as such a condition may result in cans losing momentum while transiting through the down chute 50 and thereby coming to rest on the central arcuate section 50*b* causing a jam.

At its upper extent, the central arcuate section 50*b* is preferably below the exit port 45 far enough to allow a can 1, 2, 4 passing through the exit port 45 enough room to gather momentum as it moves out of the cartridge 10 so that the can 1, 2, 4 is moved forwardly when it contacts the upper arcuate section 50*a*. This forward movement, as opposed to a simple vertical drop as in the prior art, begins rolling contact with can 3 and enables the can 1, 2, 4 to continue to block rearward movement of can 3 as it transits the exit port 45, just as it would when the can 1, 2, 4 was previously disposed between can 3 and the rear 12 and 22 of the cartridge 10 and dispenser 20, respectively.

The radius of curvature of the lower arcuate section 50*c* is preferably greater than one can radius. The radius of curvature of the upper arcuate section 50*a* will depend on the dimensioning of the central arcuate section 50*b*, and generally describe an arc from the rear most portion of the exit port 45 (lower end of the dispenser back wall 22) to the upper most aspect of the central arcuate section 50*b*. Generally, the transitions between each of the arcuate sections 50*a*, 50*b*, and 50*c* are arcuate to facilitate smooth can movement along the down chute 50, although the precise shape of these transitions is not critical to the function of the down chute 50, provided they do not impede can 1, 2, 3, 4 movement along the down chute 50.

Figure 23:
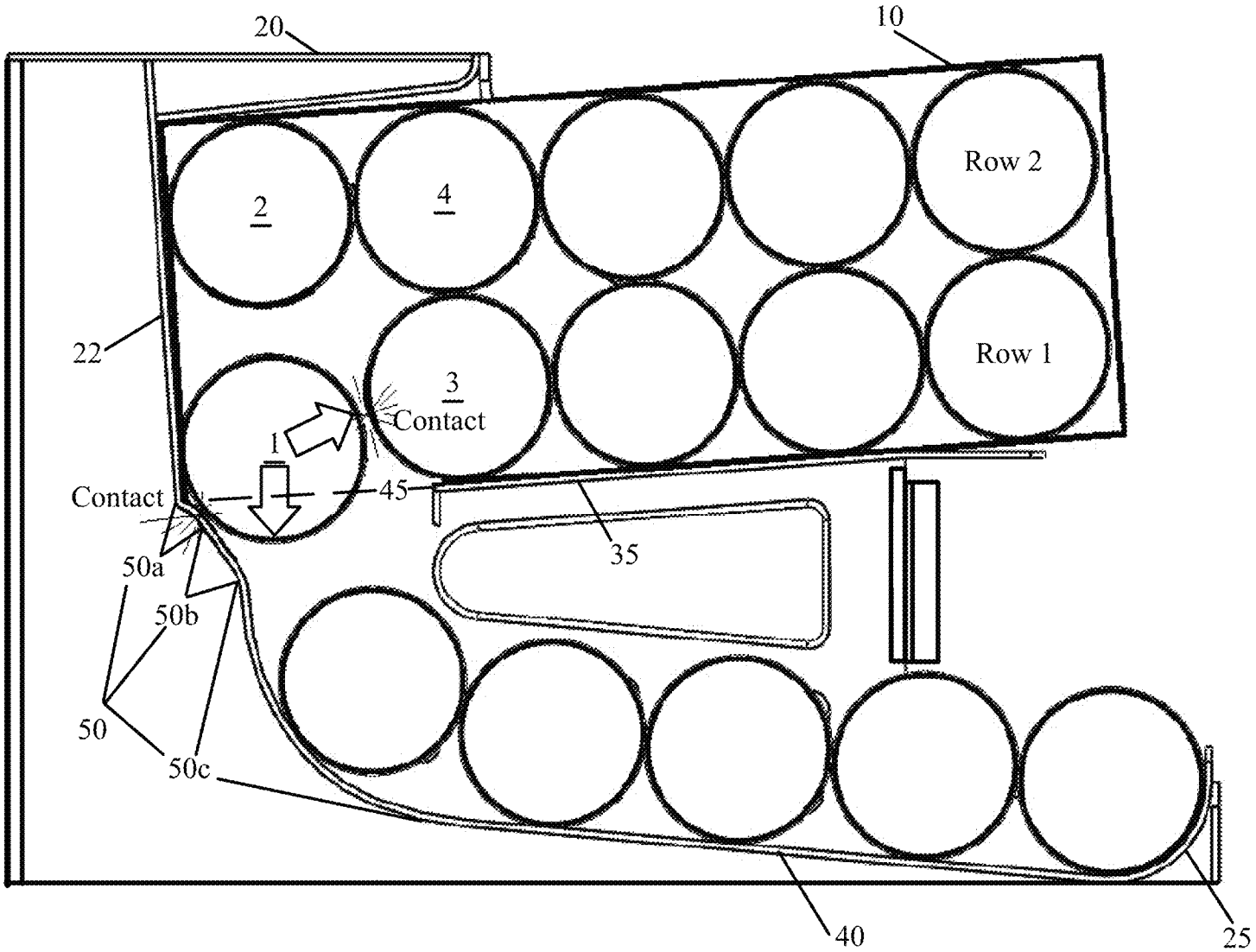
FIG. 23 shows a side view of a product dispenser having a substantially "S" shaped down chute and a lower feed ramp with a product cartridge inserted in a restocking situation.

In operation, as shown in FIG. 23, when can 1 moves downward and through the exit port 45, it contacts the down chute 50 upper arcuate section 50*a* and is diverted slightly forward, causing can 1 to maintain contact with can 3 as it enters the exit port 45, and thus inhibit movement of can 3 long enough for can 1 to fully move to the second arcuate section 50*b*, and can 2 to drop behind can 1.

Figure 24:
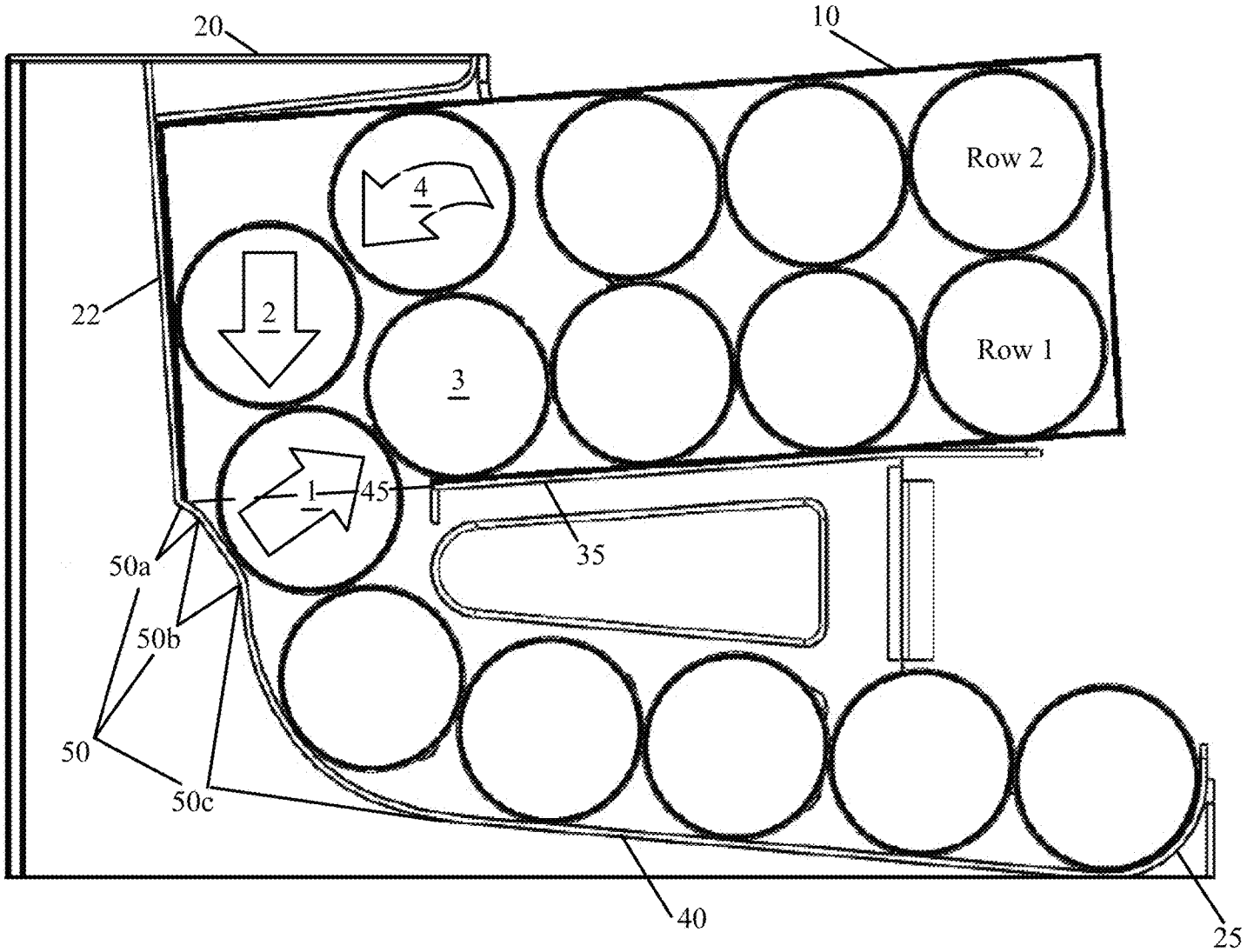
FIG. 24 shows a side view of a product dispenser having a substantially "S" shaped down chute as the first cans in each row of product in the cartridge move into the down chute.
Figure 25:
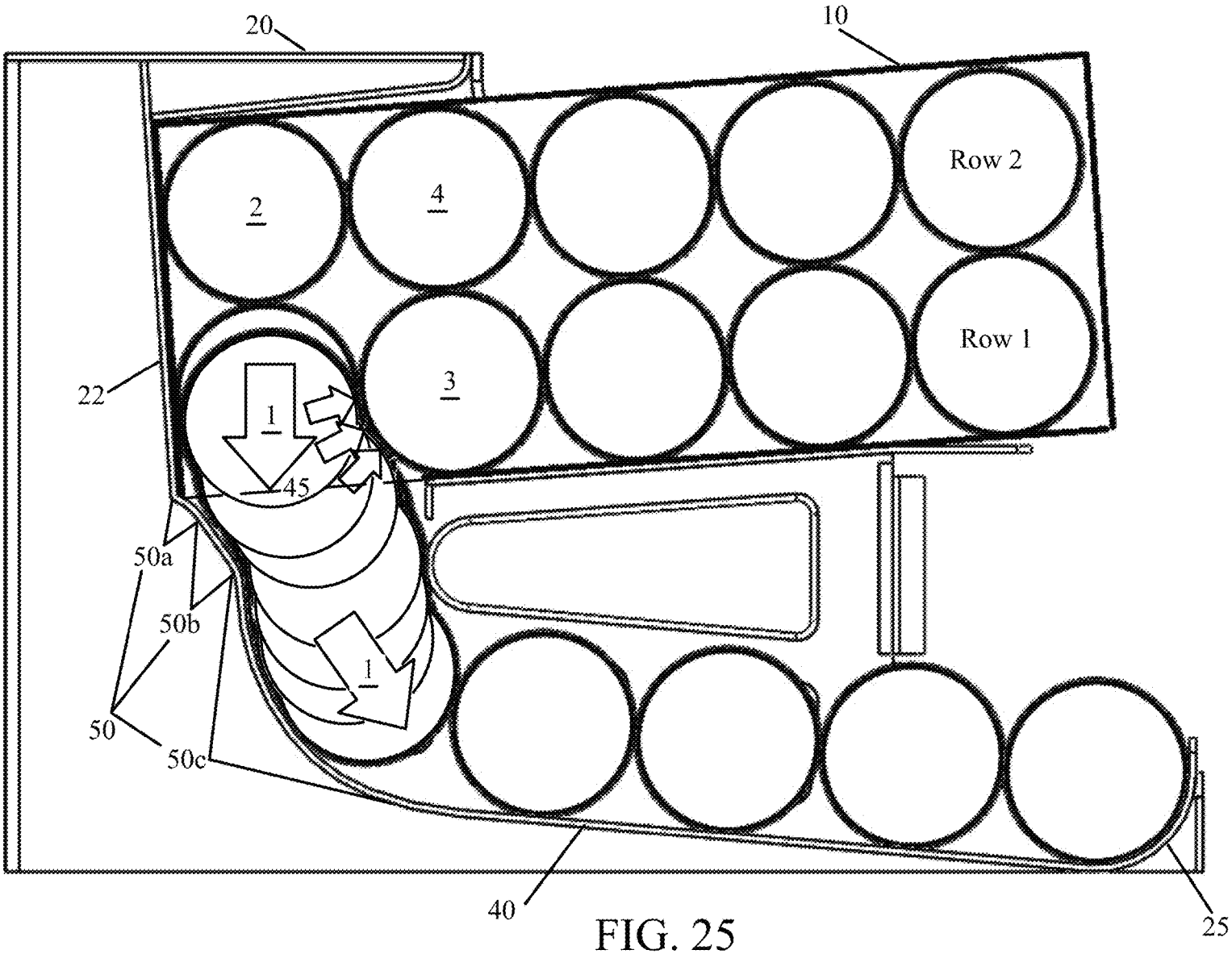
FIG. 25 shows a side view of a product dispenser having a substantially "S" shaped down chute as the first can from the first row of product in the cartridge moves through the down chute.

Referring to FIGS. 24-25, the radius of curvature and position of the central arcuate section 50*b*, constrains the movement of can 1 such that its circumference remains in rolling contact (see small arrows in FIG. 25) with the circumference of can 3 on the one side, and the down chute 50 central arcuate section 50*b* on the other side as it moves through the exit port 45 and along the down chute 50.

Figure 26:
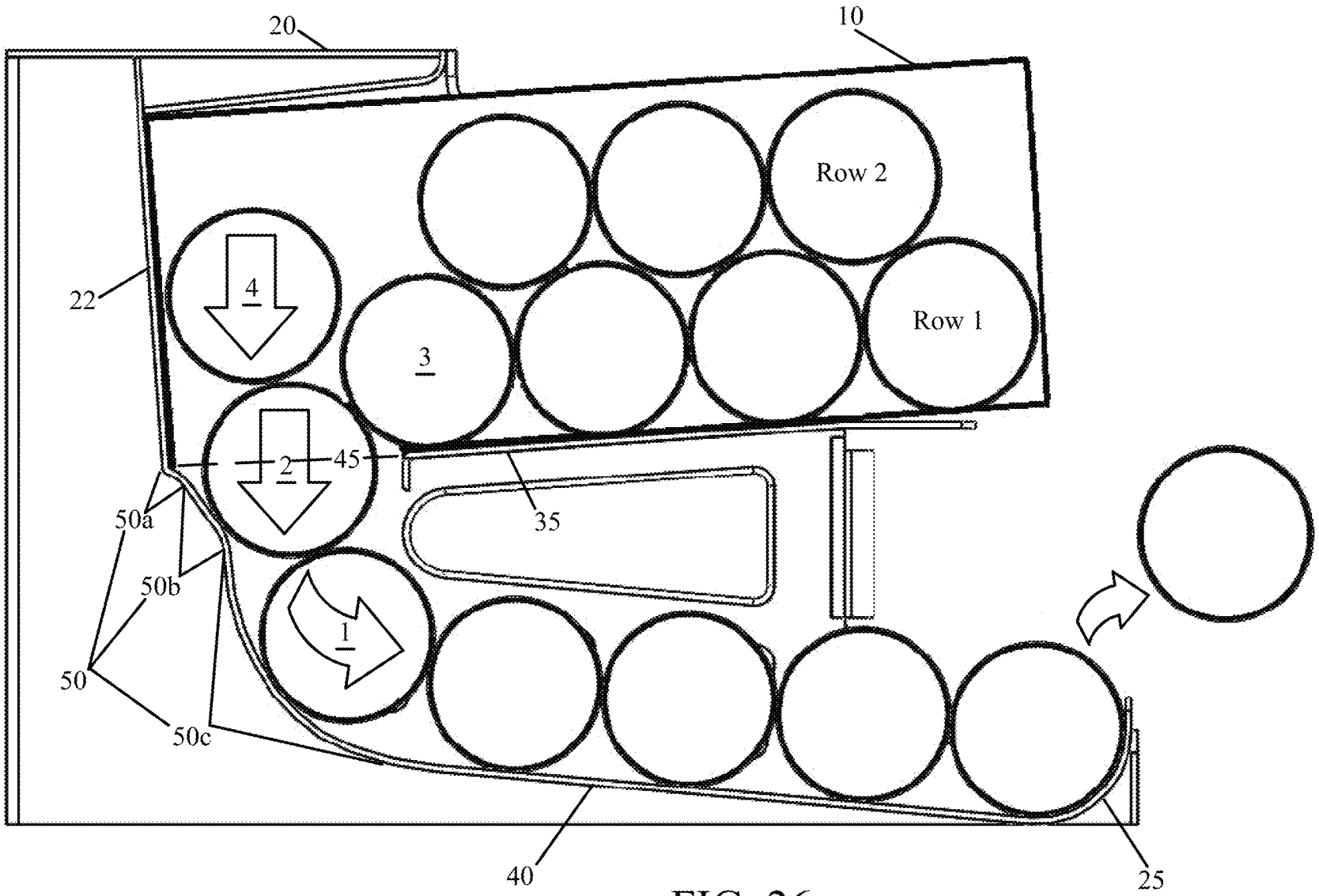
FIG. 26 shows a side view of a product dispenser having a substantially "S" shaped down chute and the position of cans from the first and second row of product in the cartridge moving through the down chute after a can is removed from the dispensing area.
Figure 27:
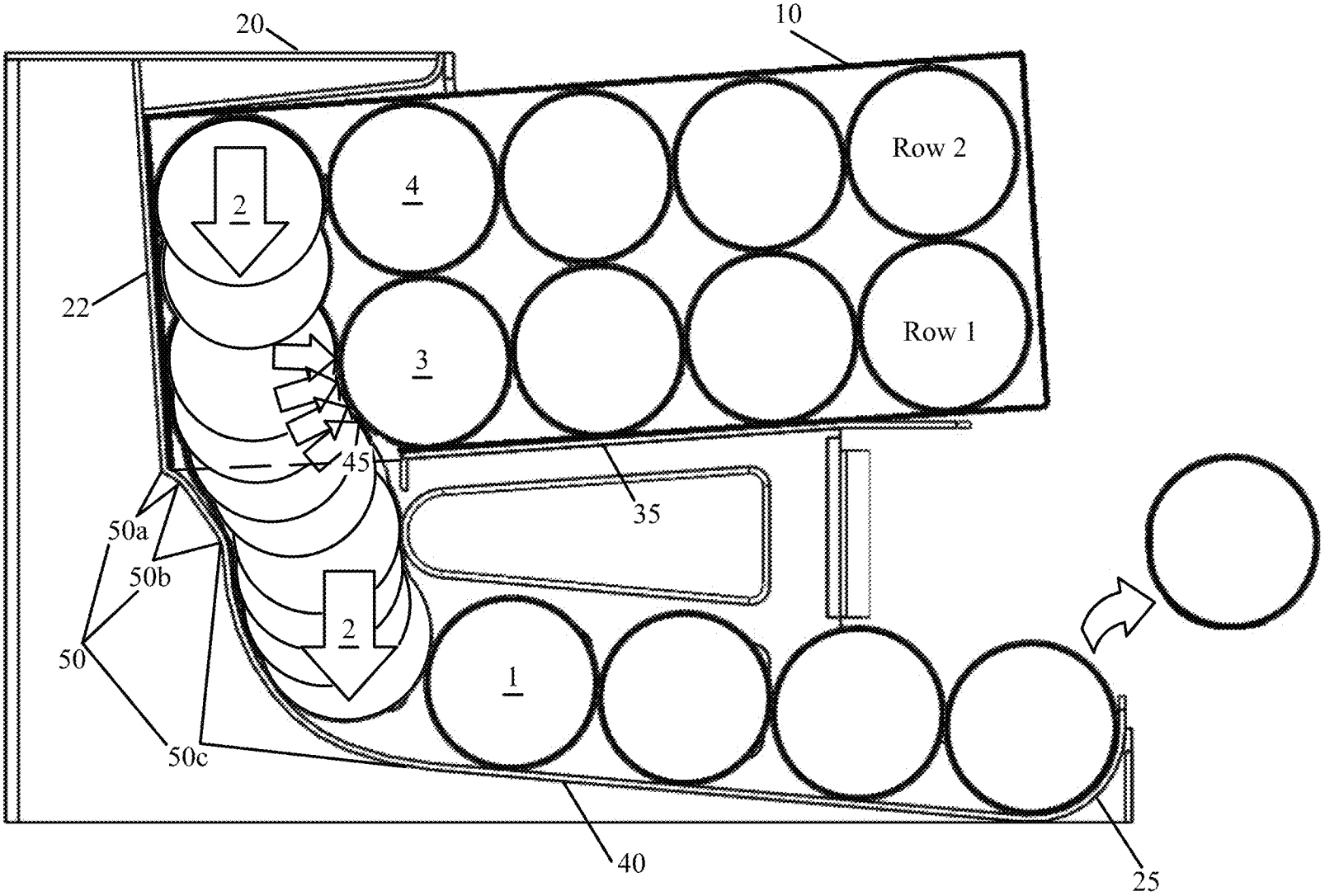
FIG. 27 shows a side view of a product dispenser having a substantially "S" shaped down chute as the first can from the second row of product in the cartridge moves through the down chute.

Thus, as shown for example in FIG. 26, all cans in the row (Row 1) behind can 3 are also held in their position in the cartridge 10, and can 2 is free to move down into the space previously occupied by can 1. Can 2 now blocks movement of can 3 and all other cans in the lower row (Row 1) of the cartridge 10, and can 4 is free to roll rearward and downward in contact with the circumference of can 3, and behind can 2. The complete motion of can 2 as it moves from its original position in the cartridge 10 to a position where it is free to move along the lower feed ramp 40 to the dispensing location 25, is shown in FIG. 27. As can be seen in this figure, the upper arcuate section 50*a* and central arcuate section control the movement of can 2 so that rolling contact between can 2 and can 3 is maintained at all times as can 2 transits through the exit port 45 and can 3 cannot move toward the exit port 45.

Figure 28:
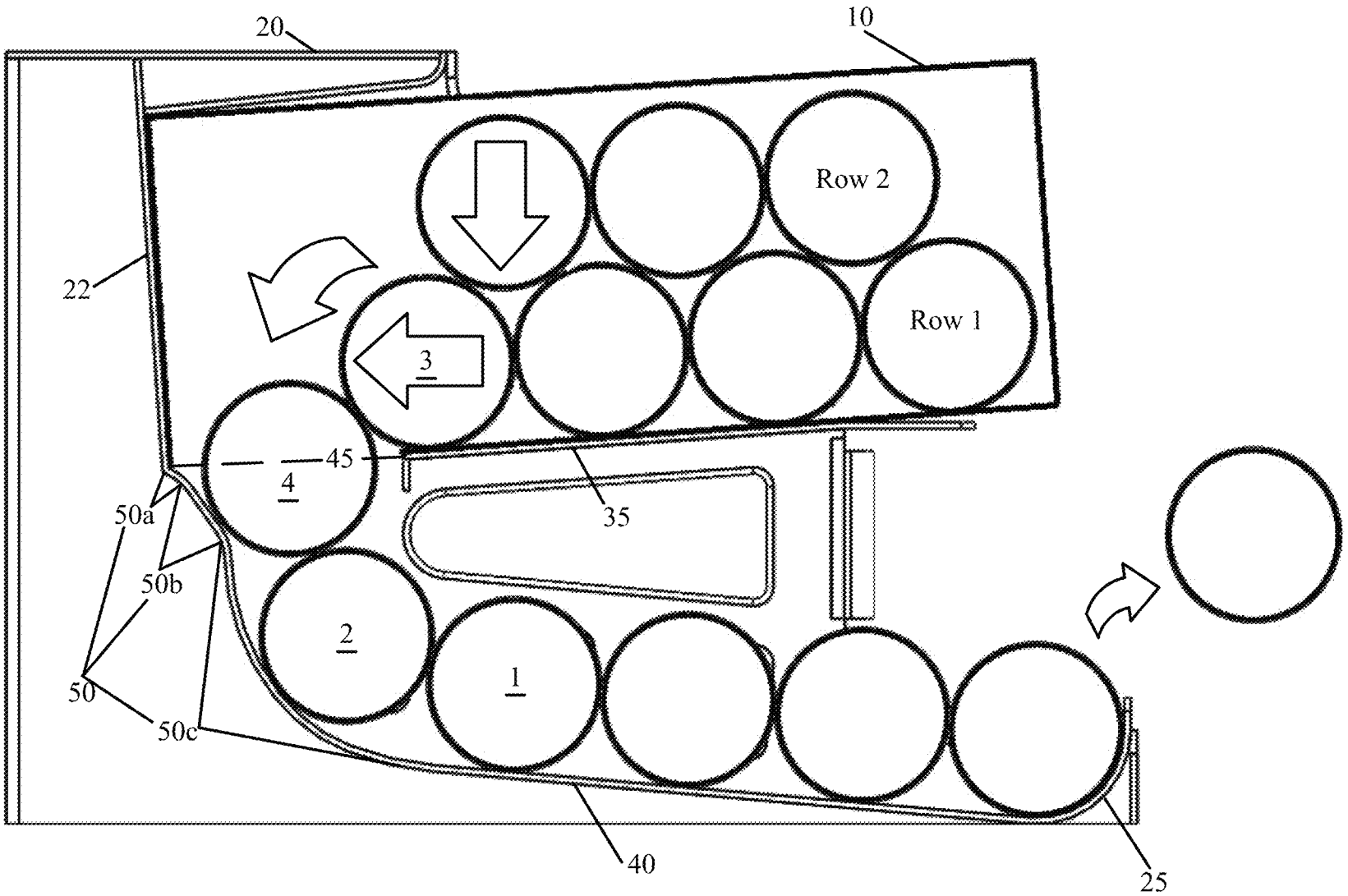
FIG. 28 shows a side view of a product dispenser having a substantially "S" shaped down chute and the position of the second can from the second row of product in the cartridge after a can is removed from the dispensing area.
Figure 29:
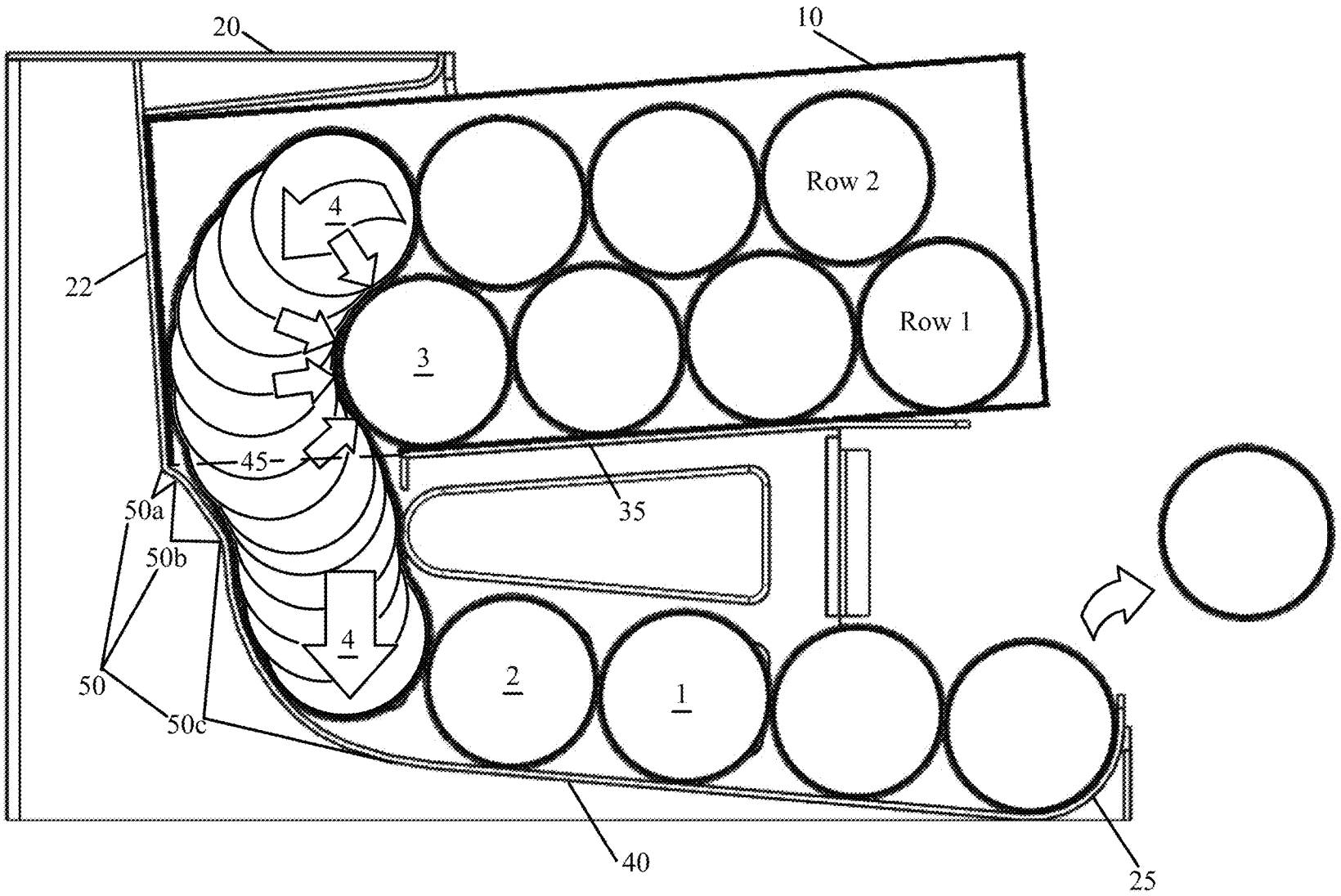
FIG. 29 shows a side view of a product dispenser having a substantially "S" shaped down chute as the second can from the second row of product in the cartridge moves through the down chute.

Referring to FIG. 28, when a consumer removes a can from the dispensing area 25, can 4 moves into a position to restrict movement of can 3 and the other cans in the lower row (Row 1) of the cartridge 10. The complete motion of can 4 as it moves from its original position in the cartridge 10 to a position where it is free to move along the lower feed ramp 40 to the dispensing location 25, is shown in FIG. 29. As was the case with can 2, the upper arcuate section 50*a* and central arcuate section control the movement of can 4 so that rolling contact between can 4 and can 3 is maintained at all times as can 4 transits through the exit port 45 and can 3 cannot move toward the exit port 45.

Figure 30:
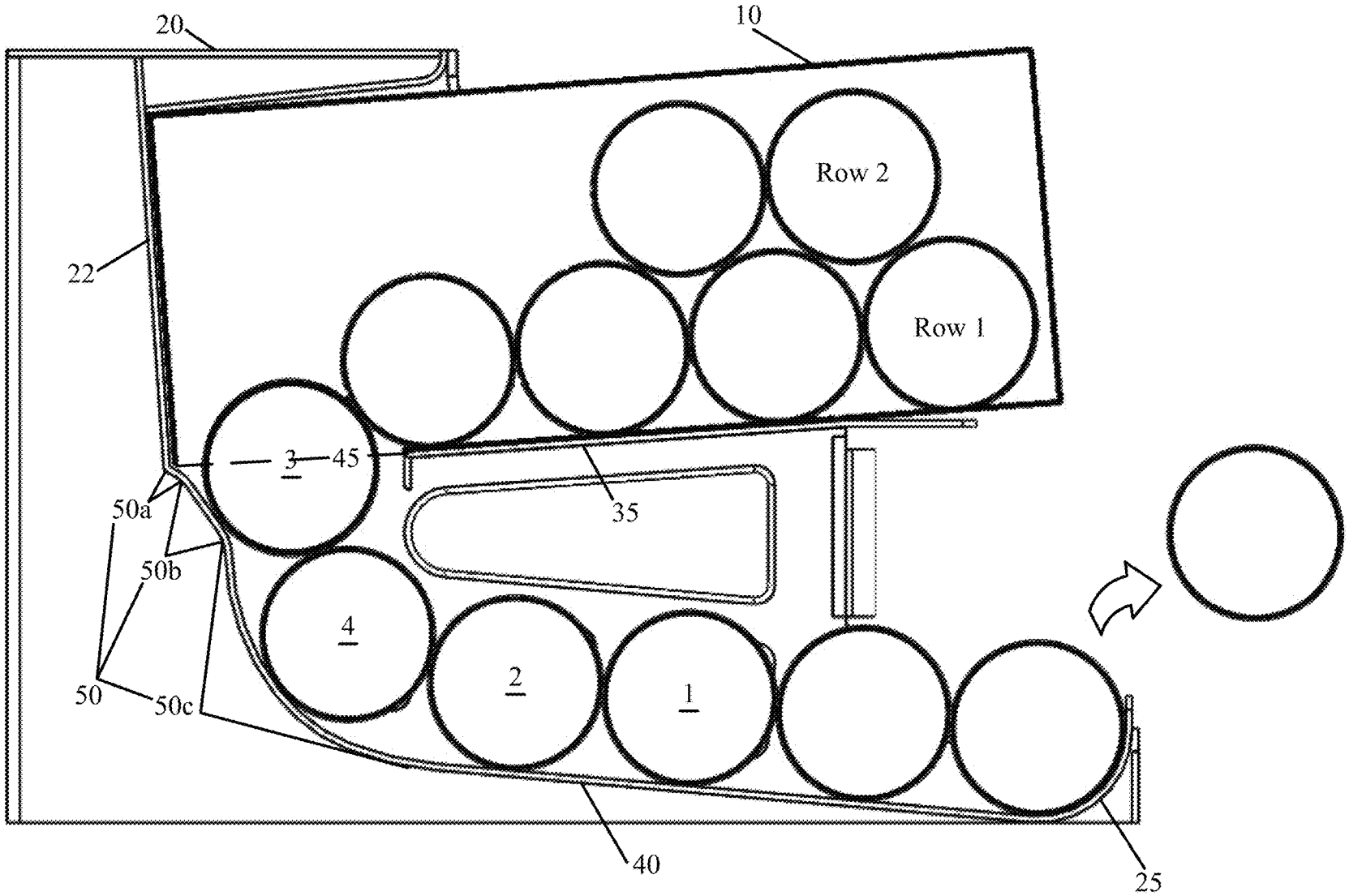
FIG. 30 shows a side view of a product dispenser having a substantially "S" shaped down chute and the position of the second cans from the first and second row of product in the cartridge after a can is removed from the dispensing area.

Finally, as shown in FIG. 30, as another can is removed from the product dispensing area 25, can 4 moves through the down chute 50, allowing the weight of cans in the upper row (Row 2) and lower row (Row 1) of the cartridge 10 to move can 3 to the exit port 45 and downwardly into the down chute 50. Once this sequence is complete, the remaining cans in the cartridge 10 are free to move, as all the jam related cans have been dispensed through the exit port 45 and along the substantially "S"-shaped down chute 50.

In addition to the above substantially "S"-shaped down chute 50 configuration, it has been found that the loading ramp 35 angle of approximately four degrees is preferably increased to a loading ramp 35 angle of between approximately five and seven degrees for very small lightweight rolling products such as cat food tins, tuna fish cans, potted meat products, and the like.

In an alternative embodiment, shown in FIGS. 32-36, the down chute 50 only includes an upper arcuate section 50*a* and a lower arcuate section 50*c*. When cans packed in the bulk cartridge or hopper are generally mid-sized, as opposed to small or very large and are of a medium weight, condensed soup cans for example, a central arcuate section 50*b* may be unnecessary in some cases. In this embodiment, cans 1, 2, 4 exit the cartridge 10 and are guided forward by the down chute 50 upper arcuate section 50*a* as they transit the exit port 45, and held in rolling contact with can 3 in the cartridge 10, sufficiently to inhibit the motion can 3 and the cans in row behind it, so that cans 1, 2, 3, 4 all exit the cartridge 10 in the one, two, four, three order that prevents jamming.

Figure 32:
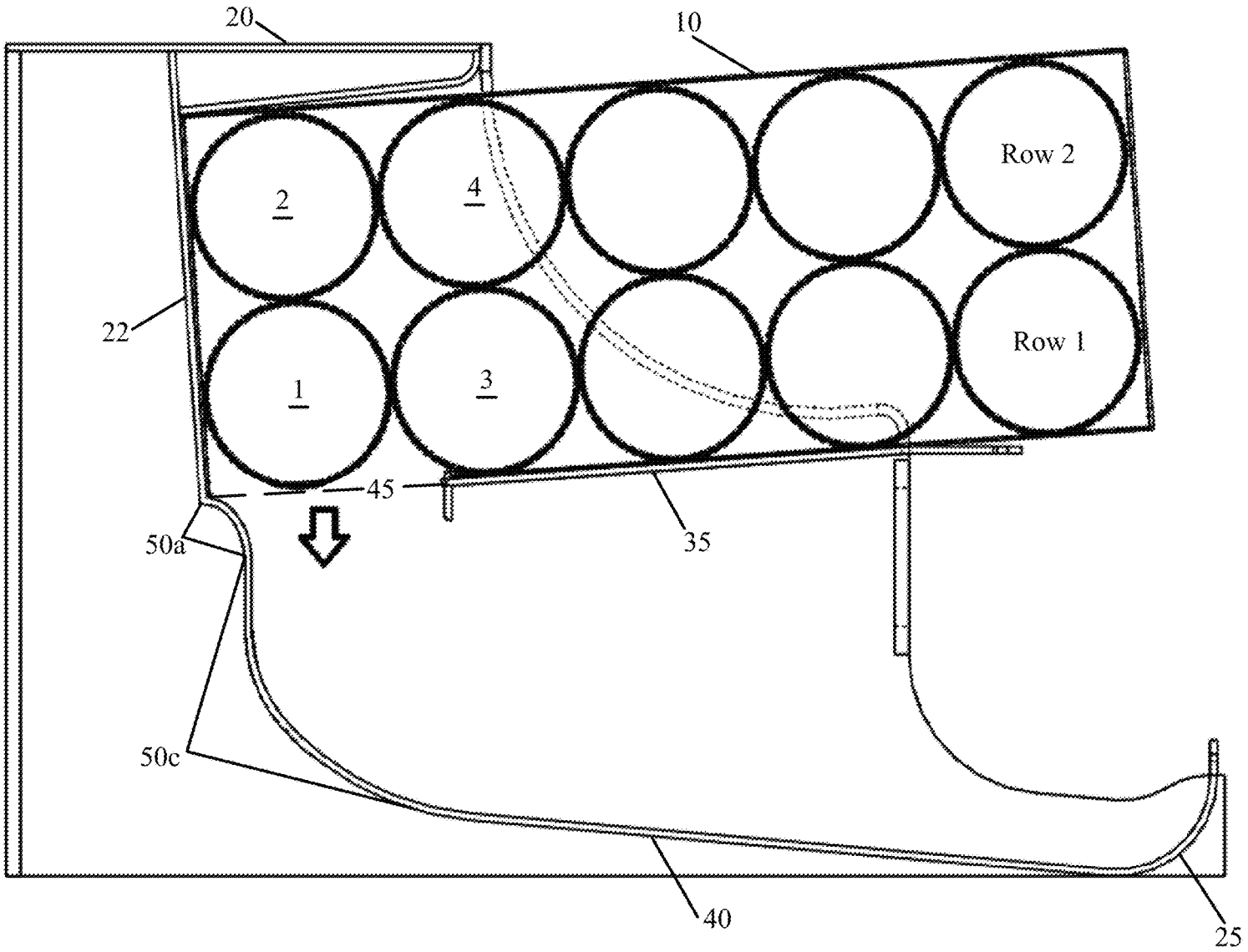
FIG. 32 shows a dispenser with a down chute having upper and lower arcuate sections when a full cartridge is inserted.
Figure 33:
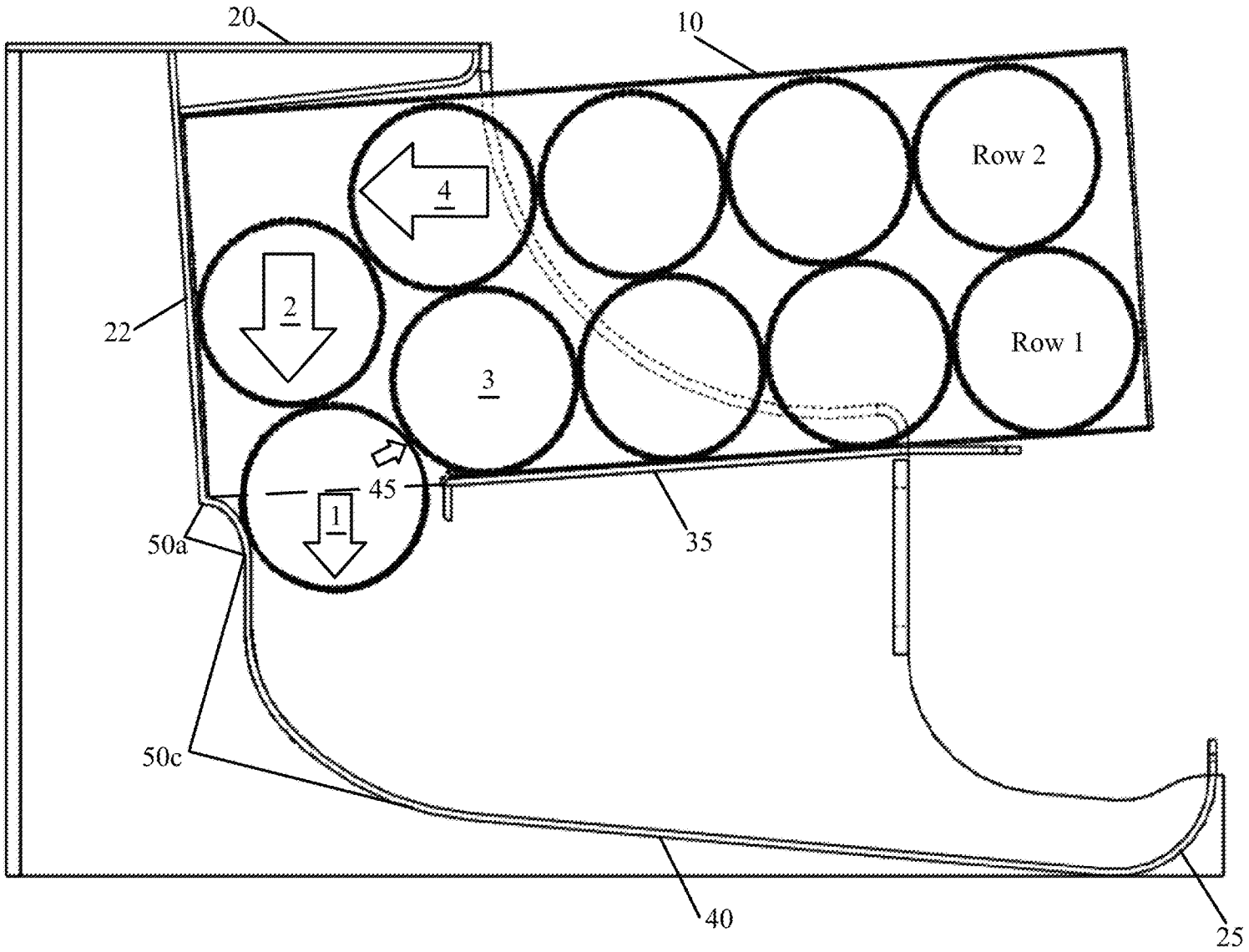
FIG. 33 shows the motion of can one through the exit port of a dispenser with a down chute having upper and lower arcuate sections.

FIG. 32 shows a dispenser 20 having a down chute 50 having an upper arcuate section 50*a* and a lower arcuate section 50C when a full cartridge 10 is first inserted. In contrast to the prior art, where can 1 would simply fall vertically downward through the exit port 45, the upper arcuate section 50*a* guides can 1 as it moves through the exit port 45. As shown in FIG. 33, as can 1 enters and begins to transit the exit port 45, it is guided forward by the upper arcuate section 50*a*. Can 1 is thus held in rolling contact (see small arrow) with can 3 in the dispenser 20. Can 3 is thus inhibited from moving toward the down chute 50, and can 2 moves vertically downward behind can 1 toward the exit port 45.

Figure 34:
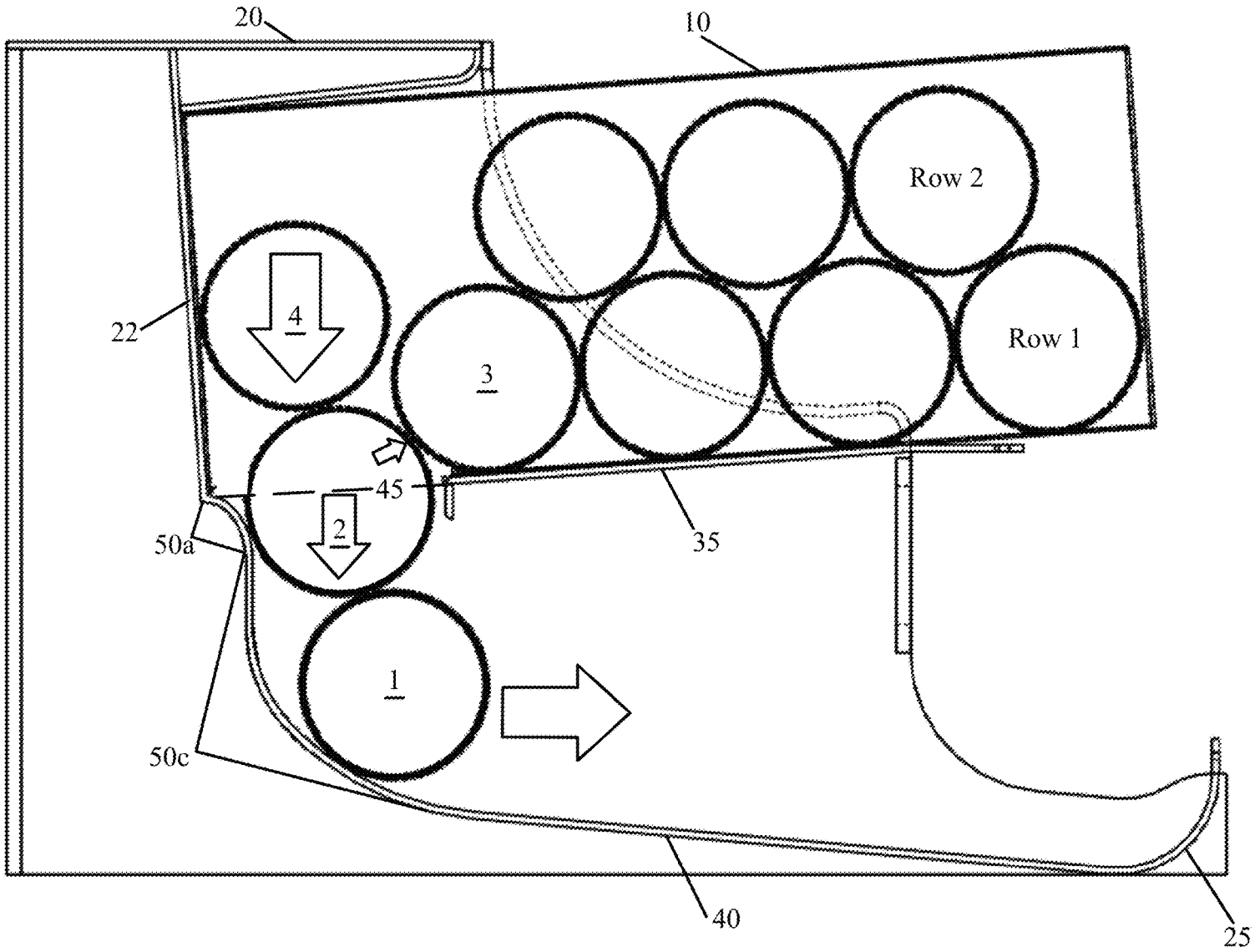
FIG. 34 shows the motion of can two through the exit port of a dispenser with a down chute having upper and lower arcuate sections.

Referring to FIG. 34, when can 1 has transited the exit port 45 and reaches the down chute 50 lower arcuate section 50*c*, can 2 begins to transit the exit port 45 and is also held in rolling contact (see small arrow) with can 3. Can 3 is again inhibited from moving toward the down chute 50, and can 4 is free to roll over can 3 (arrow in FIG. 33) and follow can 2 toward be toward the exit port 45.

Figure 35:
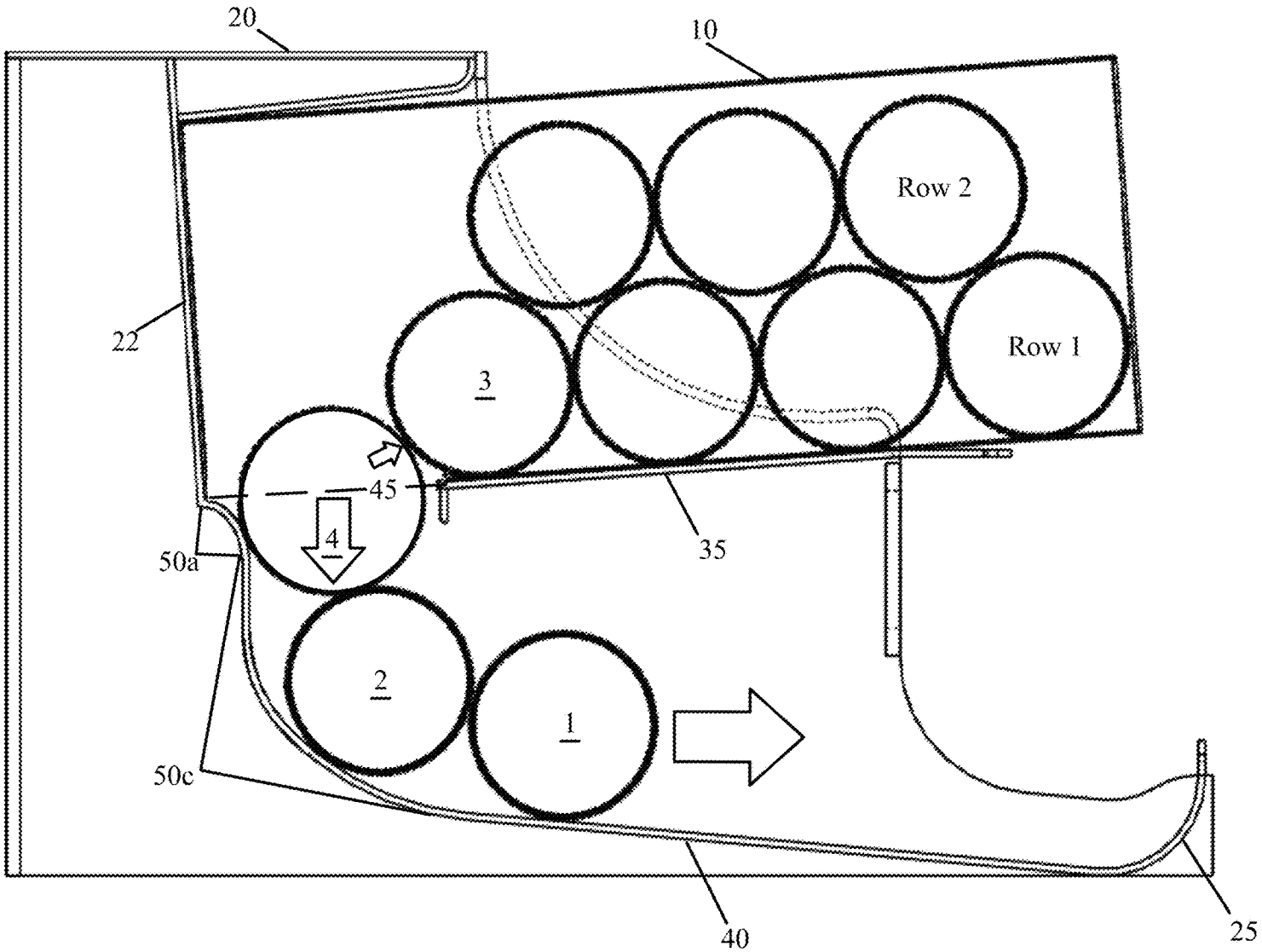
FIG. 35 shows the motion of can four through the exit port of a dispenser with a down chute having upper and lower arcuate sections.

Referring to FIG. 35, when can 1 and can 2 have transited the exit port 45 and reach the down chute 50 lower arcuate section 50*c* and lower feed ramp 40, can 4 begins to transit the exit port 45 and is also held in rolling contact (see small arrow) with can 3. Can 3 is again inhibited from moving toward the down chute 50 until can 4 has moved past the down chute upper arcuate section 50*a*.

Figure 36:
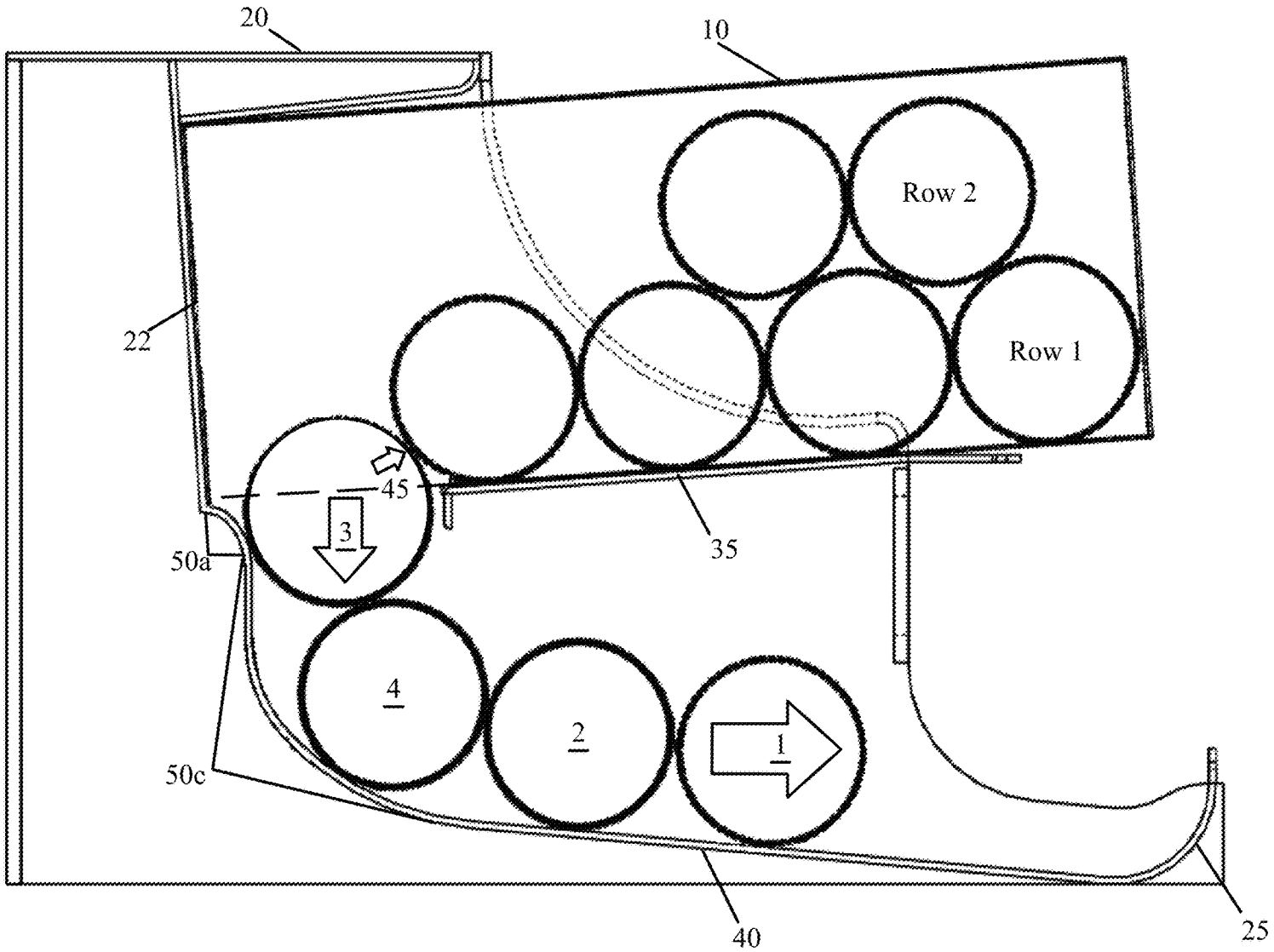
FIG. 36 shows the motion of can three through the exit port of a dispenser with a down chute having upper and lower arcuate sections.

Referring to FIG. 36, when cans 1, 2, 4 have transited the exit port 45 and reach the down chute 50 lower arcuate section 50*c* and lower feed ramp 40, can 3 transits the exit port 45. Hence, the motion of the critical first four cans 1, 2, 3, 4 in the cartridge 10 is controlled so that the cans 1, 2, 3, 4 enter the dispenser 20 in the one, two, four, three order that has been found to prevent jamming.

Those skilled in the art of dispensers will appreciate that while the word "cans" has been used interchangeably with "rolling products" or "packages", the improved down chute 50 described herein will work equally well with any products capable of rolling from cartridges 10 and through dispensers 20. Furthermore, although the improved down chute 50 has been discussed herein primarily with relation to dispensers 20 that accept pre-filled cartridges 10, as shown in FIG. 20B, the down chute 50 can also be implemented in dispensers that have bulk loading hoppers that are manually loaded and do not rely on cartridges, as reflected in FIG. 20A. In dispensers 20 that do not use pre-loaded cartridges 10, cans align themselves in the bulk loading hopper in such a manner that jams described in FIGS. 5-18 also occur. Hence the down chute 50 can be equally applied to such dispensers 20.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A serpentine product dispenser with a top, a bottom, a front, a back, a first side, and a second side, for dispensing cans having a radius from a cartridge containing a lower first row of cans and at least one upper row of cans positioned above the lower first row of cans, the dispenser comprising:

a) a loading ramp disposed between the first side of the dispenser and the second side of the dispenser near the top of the dispenser, having a first end located near the front of the dispenser and a second end located a distance from the back of the dispenser, the second end of the loading ramp forming an exit port first end, the first end of the loading ramp being higher than the second end of the loading ramp, such that the loading ramp forms an angle relative to a horizontal, biasing cans in the cartridge located on the loading ramp to roll toward the back of the dispenser;

b) a back wall forming an exit port second end separated by at least one can diameter from the exit port first end, disposed between the first side of the dispenser and the second side of the dispenser at the back of the dispenser, limiting rearward motion of the cartridge on the loading ramp;

c) an exit port between the exit port first end and exit port second end, aligned with an aperture in the cartridge on the loading ramp, such that a can may exit the cartridge through the aperture and pass through the exit port;

d) a down chute disposed between the first side of the dispenser and the second side of the dispenser near the back of the dispenser and below the exit port, comprising:

i) an upper arcuate section with a first end adjacent to the back wall of the dispenser, a second end, and a first radius of curvature therebetween, the first radius of curvature being convex toward the top of the dispenser and the front of the dispenser;

ii) a central arcuate section with a first end adjacent to the second end of the upper arcuate section, a second end, and a second radius of curvature therebetween, the second radius of curvature being concave away from the top of the dispenser and the front of the dispenser; and iii) a lower arcuate section with a first end adjacent to the second end of the central arcuate section, a second end, and a third radius of curvature therebetween, the third radius of curvature being concave away from the top of the dispenser and the front of the dispenser;

wherein the upper convex arcuate section forms a rolling surface extending downwardly and forwardly from the exit port second end; such that, when a first can is moving through the exit port in rolling contact with the upper convex arcuate section, the first can is guided toward the exit port second end by the upper convex arcuate section such that the first can is in rolling contact with a second can from the lower first row of cans in the cartridge, thereby inhibiting movement of the second can toward the exit port, such that when the first can is in rolling contact with the central arcuate section, the first can remains in rolling contact with the second can from the lower first row, thereby continuing to inhibit movement of the second can toward the exit port as the first can rolls on the central arcuate section, and such that a can moving along the lower arcuate section is directed toward the bottom of the dispenser and the front of the dispenser.

2. The serpentine product dispenser of claim 1, in which the angle formed by the loading ramp relative to the horizontal is eight degrees or less.

3. The serpentine product dispenser of claim 1, wherein the cartridge is a hopper volume enclosed by at least the back of the dispenser and the loading ramp.

4. The serpentine product dispenser of claim 1, wherein the second radius of curvature of the central arcuate section of the down chute is approximately three times the radius of a can contained in the cartridge.

5. The serpentine product dispenser of claim 4, wherein the cartridge is made from a material with a thickness, and the radius of curvature of the central arcuate section of the down chute is increased by at least the thickness of the material of the cartridge.

6. The serpentine product dispenser of claim 1, wherein the radius of curvature of the central arcuate section of the down chute has an origin located above the loading ramp a distance approximately equal to the radius of a can contained in the cartridge, and forward of the back wall a distance of approximately three times the radius of the can.

7. The serpentine product dispenser of claim 6, wherein the cartridge is made from a material with a thickness, and the location of the origin of the radius of curvature of the central arcuate section of the down chute is offset by at least an amount equal to the thickness of the material of the cartridge.

8. A product dispenser with a top, a bottom, a front, a back, a first side, and a second side, for dispensing cans having a radius from a hopper volume arranged as a lower first row of cans and at least one upper row of cans positioned above the lower first row of cans, the dispenser comprising:

a) a loading ramp disposed between the first side of the dispenser and the second side of the dispenser near the top of the dispenser, having a first end located near the front of the dispenser and a second end located a distance from the back of the dispenser, the second end of the loading ramp forming an exit port first end, the first end of the loading ramp being higher than the second end of the loading ramp, such that the loading ramp forms an angle relative to a horizontal, biasing cans in the hopper volume located above the loading ramp to roll toward the back of the dispenser;

b) a back wall forming an exit port second end separated by at least one can diameter from the exit port first end, disposed between the first side of the dispenser and the second side of the dispenser at the back of the dispenser;

c) an exit port between the exit port first end and exit port second end, such that a can may pass through the exit port;

d) a down chute disposed between the first side of the dispenser and the second side of the dispenser near the back of the dispenser and below the exit port, comprising:

i) an upper arcuate section with a first end adjacent to the back wall of the dispenser, a second end, and a first radius of curvature therebetween, the first radius of curvature being convex toward the top of the dispenser and the front of the dispenser;

ii) a central arcuate section with a first end adjacent to the second end of the upper arcuate section, a second end, and a second radius of curvature therebetween, the second radius of curvature being concave away from the top of the dispenser and the front of the dispenser;

iii) a lower arcuate section with a first end adjacent to the second end of the central arcuate section, a second end, and a third radius of curvature therebetween, the third radius of curvature being concave away from the top of the dispenser and the front of the dispenser;

wherein the upper arcuate section, the central arcuate section, and the lower arcuate section combine to form a downwardly and forwardly rolling surface extending downwardly and forwardly from the exit port second end; such that, when a first can from the lower first row of cans moves through the exit port in rolling contact with the upper convex arcuate section, the first can is guided toward the exit port second end by the upper convex arcuate section such that the first can is in rolling contact with a second can from the lower first row of cans, thereby inhibiting movement of the second can toward the exit port, such that when the first can is in rolling contact with the central arcuate section, the first can remains in rolling contact with the second can from the lower first row of cans, thereby continuing to inhibit movement of the second can toward the exit port as the first can rolls on the central arcuate section, and whereby a can rolling on the lower arcuate section is directed toward the bottom of the dispenser and the front of the dispenser.

9. The product dispenser of claim 8, wherein the hopper volume is enclosed by at least the back of the dispenser and the loading ramp.

10. The product dispenser of claim 8 wherein the angle formed by the loading ramp relative to horizontal is eight degrees or less.

11. The product dispenser of claim 8 wherein the hopper volume is bounded by at least the back of the dispenser and the loading ramp.

12. The product dispenser of claim 8 wherein the second radius of curvature of the central arcuate section of the down chute is approximately three times the radius of one of the cans contained in the hopper.

13. The product dispenser of claim 12 wherein the lower first row of cans and the at least one upper row of cans are contained within a cartridge received within the hopper, and wherein the cartridge is made from a material with a thickness, and the radius of curvature of the central arcuate section of the down chute is increased by at least the thickness of the material of the cartridge.

14. The product dispenser of claim 8, wherein the radius of curvature of the central arcuate section of the down chute has an origin located above the loading ramp a distance approximately equal to the radius of a can contained in the hopper, and forward of the back wall a distance of approximately three times the radius of the can.

15. The product dispenser of claim 14 wherein the lower first row of cans and the at least one upper row of cans are contained within a cartridge received within the hopper, and wherein the cartridge is made from a material with a thickness and the location of the origin of the radius of curvature of the central arcuate section of the down chute is offset by at least an amount equal to the thickness of the material of the cartridge.

* * * * *